US009850682B2

(12) United States Patent
Lay

(10) Patent No.: US 9,850,682 B2
(45) Date of Patent: Dec. 26, 2017

(54) FOLDABLE STRUCTURE

(71) Applicant: William Coleman Lay, Saint George, UT (US)

(72) Inventor: William Coleman Lay, Saint George, UT (US)

( * ) Notice: Subject to any disclaimer, the term of this patent is extended or adjusted under 35 U.S.C. 154(b) by 421 days.

(21) Appl. No.: 13/852,979

(22) Filed: Mar. 28, 2013

(65) Prior Publication Data

US 2014/0295110 A1 Oct. 2, 2014

(51) Int. Cl.
*A47G 5/00* (2006.01)
*E04H 15/40* (2006.01)

(52) U.S. Cl.
CPC ..... *E04H 15/40* (2013.01)

(58) Field of Classification Search
CPC ..... E04B 1/343; E04B 1/34357; E04H 15/40; E04H 15/405
USPC ..... 160/354, 370.21, 351, 377; 273/398–402; 473/478
See application file for complete search history.

(56) References Cited

U.S. PATENT DOCUMENTS 5,213,147 A * 5/1993 Zheng ..... 160/370.21
5,439,017 A * 8/1995 Brown ..... 135/126
5,569,094 A * 10/1996 Macaluso ..... 473/197
RE35,571 E * 7/1997 McLeese ..... E04H 15/40 135/126
5,645,096 A 7/1997 Hazinski
5,713,624 A * 2/1998 Tower ..... 296/152
5,816,278 A * 10/1998 Kim ..... E04H 15/425 135/117
5,976,023 A 11/1999 Cho
5,992,045 A * 11/1999 Kellogg ..... D06F 57/00 160/370.21
6,109,282 A * 8/2000 Yoon ..... E04H 15/40 135/124
6,135,894 A 10/2000 Cho
6,247,699 B1 * 6/2001 Macaluso ..... 273/400
6,312,343 B1 11/2001 Cho
6,514,149 B2 2/2003 Yoon
6,517,444 B1 * 2/2003 Yoon ..... 473/197
6,543,776 B2 * 4/2003 Macaluso ..... 273/400
6,554,717 B2 4/2003 Cho
6,634,040 B2 * 10/2003 Le Gette et al. ..... 5/417
6,736,740 B2 * 5/2004 Zheng ..... 473/471
RE38,591 E * 9/2004 Kellogg et al. ..... 34/442
6,942,005 B2 * 9/2005 Le Gette ..... E04H 15/40 160/368.1
7,127,754 B2 10/2006 Le Gette
7,198,274 B2 4/2007 Cho
7,490,378 B2 * 2/2009 Le Gette et al. ..... 5/417
7,600,759 B2 * 10/2009 Crawley et al. ..... 273/396
7,648,421 B2 1/2010 Yoon (Continued)

*Primary Examiner* — Katherine W Mitchell
*Assistant Examiner* — Johnnie A. Shablack
(74) *Attorney, Agent, or Firm* — Madson IP, P.C.

(57) ABSTRACT

The present invention provides for the first time a foldable structure comprising a resilient frame and a coiling-assist assembly for facilitating coiling the resilient frame while folding. The coiling-assist assembly comprises a releasable grasp coupled to the resilient frame at a pre-determined first location. The releasable grasp temporarily holds the resilient frame in a first folding configuration, whereby the pre-determined second location of the resilient frame is diametrically opposed to the pre-determined first location of the resilient frame.

30 Claims, 14 Drawing Sheets

(56) References Cited

U.S. PATENT DOCUMENTS

| | | | | |
|---|---|---|---|---|
| 7,950,173 | B2 * | 5/2011 | Jedlicka | 40/610 |
| 8,567,424 | B2 * | 10/2013 | Hill, Sr. | E04H 15/322 135/125 |
| 2012/0302381 | A1 | 11/2012 | Lay | |

* cited by examiner

FOLDABLE STRUCTURE

BACKGROUND OF THE INVENTION

1. Field of the Invention

The present invention relates to foldable structures and more particularly to resilient foldable structures that coil when folding.

2. Description of the Prior Art

One reason people use resilient foldable structures that coil when folding is because of convenience. The slang term used for this type of structure is "pop-up". For example, people purchase pop-up nets, pop-up tents, pop-up sun-shades, pop-up canopies, pop-up green screens, pop-up sun scrims, pop-up reflectors used in photography, and other pop-up products for many different applications.

The reason this type of foldable structure is so popular is because when you purchase a pop-up structure all you have to do is take the structure out of the box and toss it outward and the resilient coilable structure automatically pops-up (unfolds) and is ready to use. Then to fold the coilable structure for storage, all you have to do is coil the resilient frame back up and the frame structure quickly folds for storage.

When this "pop-up" structure was first introduced it was tremendously popular because there was "no assembly required".

However, as the coilable resilient frame structure began to gain popularity in the market place the user quickly learned that unfolding the frame structure was a snap, but learning how to coil it back up was a very precise operation and was very difficult and for some people it was next to impossible.

One example of this type of folding problem featured a sales rep. who represented a company that made pop-up nets. This type of pop-up net is used by ball players to practice throwing baseballs, softballs, footballs, and other types of objects into the net. He said the first time he took the folded pop-up net out of his vehicle and into the store to demonstrate to a sporting goods buyer that he opened up the net and it quickly popped-up as expected. Then he began his sales presentation and showed how easy it was to use. Then the embarrassing part came, when he began to explain how easy it was to coil for quick assembly, he began coiling the resilient frame back up but couldn't get it to coil. After making several unsuccessful attempts to foldably coil the resilient frame back up, he was so embarrassed that he just left the unfolded pop-up net with the buyer because he couldn't fit it back in his vehicle.

Another example of this type of folding problem occurred with a dealer/buyer who was testing a pop-up net to consider purchasing for a line of chain stores, but when he tried to foldably coil the pop-up net for storage, he couldn't figure out how to coil it back up. Since then the buyer has moved most of his purchases on to purchasing ball nets that don't require coiling for folding.

In summary, the resilient coilable frame structure sometimes known as a "pop-up" frame structure is one of the easiest types of frame structures to set-up because there is "no assembly required" but foldably coiling the resilient frame structure back up for storage is almost next to impossible. Because of this difficulty in folding, the popularity of this type of coilable resilient frame structure is losing its popularity and people are moving on to other less convenient frame structure designs that are easier to fold.

The inventor knows of no known examples of prior art that discloses a solution for providing a way to facilitate coiling a resilient foldable frame structure.

3. Objective of the Invention.

It is an objective of the present invention to accomplish at least one of the following objects and advantages.

It is an object of the present invention to provide a coiling-assist assembly to facilitate coiling a resilient frame while folding.

It is another object of the present invention to make it easy for a person to fold a coilable resilient frame structure.

Further objects and advantages of the present invention will become apparent upon reading the following detailed description of exemplary embodiments of the invention when taken in conjunction with the appended claims.

BRIEF SUMMARY OF THE INVENTION

In accordance with one exemplary embodiment, there is provided for the first time a foldable structure comprising a resilient frame and a coiling-assist assembly for facilitating coiling the resilient frame while folding.

The coiling-assist assembly includes a releasable grasp coupled to the resilient frame at a pre-determined first location. The releasable grasp temporarily holds the resilient frame in a first folding configuration whereby the pre-determined second location of the resilient frame is diametrically opposed to the pre-determined first location of the resilient frame.

In another exemplary embodiment, the coiling-assist assembly further comprises a latch coupled to the resilient frame at a pre-determined third location and a releasable fastener coupled to the resilient frame at a pre-determined fourth location. The releasable fastener removably connects with the latch for temporarily holding the resilient frame in a second folding configuration.

In yet another exemplary embodiment, the coiling-assist assembly further comprises a latch coupled to the resilient frame at a pre-determined third location, a slip member coupled to the resilient frame at a pre-determined fourth location, and a releasable fastener coupled to the slip member. The releasable fastener removably connects with the latch for temporarily holding the resilient frame in a second folding configuration.

In another exemplary embodiment, the coiling-assist assembly further comprises a mount coupled to the resilient frame at a pre-determined fifth location and a tether having a first end and a second end. The first end of the tether is coupled to the mount. The tether moves the resilient frame from the second folding configuration to a folded configuration when force is applied to the tether.

In still another exemplary embodiment, the coiling-assist assembly further comprises an anchor coupled to the resilient frame at a pre-determined sixth location and a tether having a first end and a second end. The first end of the tether is coupled to the anchor. The tether moves the resilient frame from the second folding configuration to a folded configuration when force is applied to the tether.

In yet another exemplary embodiment, the coiling-assist assembly further comprises a glide member coupled to the resilient frame at a pre-determined seventh location. The second end of the tether is slidably coupled with the glide member for allowing the tether to slide when force is applied to the tether.

In another exemplary embodiment, the coiling-assist assembly further comprises a glide member coupled to the resilient frame at a pre-determined seventh location. The second end of the tether is slidably coupled with the glide member for allowing the tether to slide when force is applied to the tether.

In another exemplary embodiment, the coiling-assist assembly further comprises a restraining member having a proximal end and a distal end. The proximal end of the restraining member is coupled to the mount and the distal end of the restraining member is coupled to the slip member. The restraining member constrains at least a portion of the resilient frame while the resilient frame moves to the first folding configuration.

In yet another exemplary embodiment, the coiling-assist assembly further comprises a restraining member having a proximal end and a distal end. The proximal end of the restraining member is coupled to an anchor and the distal end of the restraining member is coupled to the slip member. The restraining member constrains at least a portion of the resilient frame while the resilient frame moves to the first folding configuration.

In still another exemplary embodiment, the coiling-assist assembly further comprises a restraining member having a proximal end and a distal end. The proximal end of the restraining member is coupled to the anchor and the distal end of the restraining member is coupled to the slip member. The restraining member constrains at least a portion of the resilient frame while the resilient frame moves to the first folding configuration.

In yet another exemplary embodiment, the coiling-assist assembly further comprises a restraining member having a proximal end and a distal end. The proximal end of the restraining member is coupled to a mount and the distal end of the restraining member is coupled to the slip member. The restraining member constrains at least a portion of the resilient frame while the resilient frame moves to the first folding configuration.

In another exemplary embodiment, the resilient frame is substantially round in shape.

In still another exemplary embodiment, the foldable structure further comprises a skirt coupled to at least a portion of the resilient frame.

In another exemplary embodiment, the foldable structure further comprises a barrier coupled to the resilient frame.

In yet another exemplary embodiment, the foldable structure further comprises a base coupled to the resilient frame.

In still another exemplary embodiment, the foldable structure further comprises a handle coupled to the second end of the tether.

Other features of the present invention will become apparent upon reading the following detailed description of embodiments of the invention when taken in conjunction with the appended claims.

BRIEF DESCRIPTION OF THE DRAWINGS

Exemplary embodiments of the present invention representing the best mode presently contemplated of carrying out the invention are illustrated in the accompanying drawings.

To further clarify the above and other advantages and features of the present invention, a more particular description of the invention will be rendered by references to specific embodiments thereof, which are illustrated in the appended drawings. It is appreciated that these drawings depict only exemplary embodiments of the invention and are therefore not to be considered limiting of its scope. The invention will be described and explained with additional specificity and detail through the use of the accompanying drawings in which.

Figure 1:
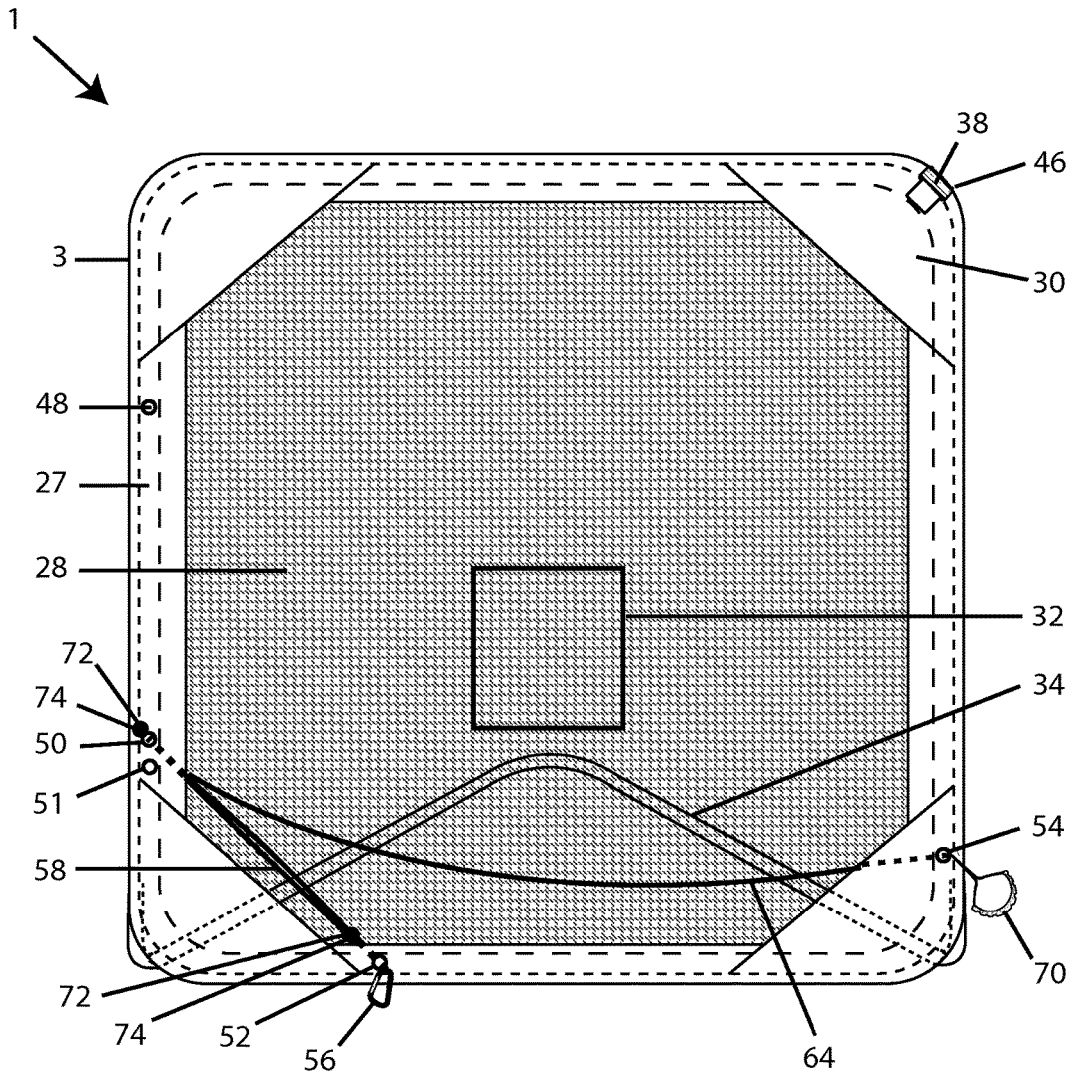
FIG. 1 is a front view of a foldable structure.

| REFERENCE NUMERALS |
|---|
| foldable structure 1 |
| frame assembly 2 |
| resilient frame 3 |
| center point 4 |
| diagonal line 5 |
| pre-determined first location 6 |
| pre-determined second location 8 |
| pre-determined third location 10 |
| pre-determined fourth location 12 |
| pre-determined fifth location 14 |
| pre-determined sixth location 16 |
| pre-determined seventh location 17 |
| upper side 18 |
| left side 20 |
| lower side 22 |
| right side 24 |
| substantially round in shape 25 |
| substantially square in shape 26 |
| skirt 27 |
| barrier 28 |
| at least one corner support 30 |
| target 32 |
| base 34 |
| coiling-assist assembly 36 |

-continued

| REFERENCE NUMERALS |
| --- |
| releasable grasp 38 |
| c-shaped section 40 |
| void 41 |
| securement member 42 |
| affixing member 43 |
| inverted u-shaped lip 44 |
| at least one adhering member 46 |
| latch 48 |
| mount 50 |
| anchor 51 |
| slip member 52 |
| glide member 54 |
| releasable fastener 56 |
| restraining member 58 |
| proximal end 60 |
| distal end 62 |
| tether 64 |
| first end 66 |
| second end 68 |
| handle 70 |
| cover 72 |
| stopper 74 |
| unfolded configuration 76 |
| first folding configuration 78 |
| second folding configuration 80 |
| folded configuration 82 |

DETAILED DESCRIPTION OF THE INVENTION

Exemplary embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the apparatus, system, and/or method of the present invention, as represented in FIGS. 1 through 19, is not intended to limit the scope of the invention, as claimed, but is merely representative of exemplary embodiments of the invention.

The phrases "attached", "attached to", "connected", "connected to," "coupled", "coupled to" and/or "in communication with" refer to any form of interaction between two or more entities, including mechanical, electrical, magnetic, electromagnetic, fluid, and/or thermal interaction. Two components may be "attached", "attached to", "connected", "connected to", "coupled", "coupled to", and/or "in communication with" to each other even though they are not in direct contact with each other.

The word "exemplary" is used herein to mean "serving as an example, instance, or illustration." Any embodiment described herein as "exemplary" is not necessarily to be construed as preferred or advantageous over other embodiments.

While the various aspects of the embodiments are presented in drawings, the drawings are not necessarily drawn to scale unless specifically indicated.

1. Exemplary Embodiments—How To Make And Assemble By Reference Numeral

Foldable Structure 1 in FIGS. 1-19 illustrate a foldable structure 1, elements associated with the foldable structure 1, and/or parts associated with the foldable structure 1. In one exemplary embodiment, the foldable structure 1 comprises two sub-assemblies. A Frame Assembly 2 and a Coiling-Assist Assembly 36. The Coiling-Assist Assembly 36 couples to the Frame Assembly 2.

Figure 2:
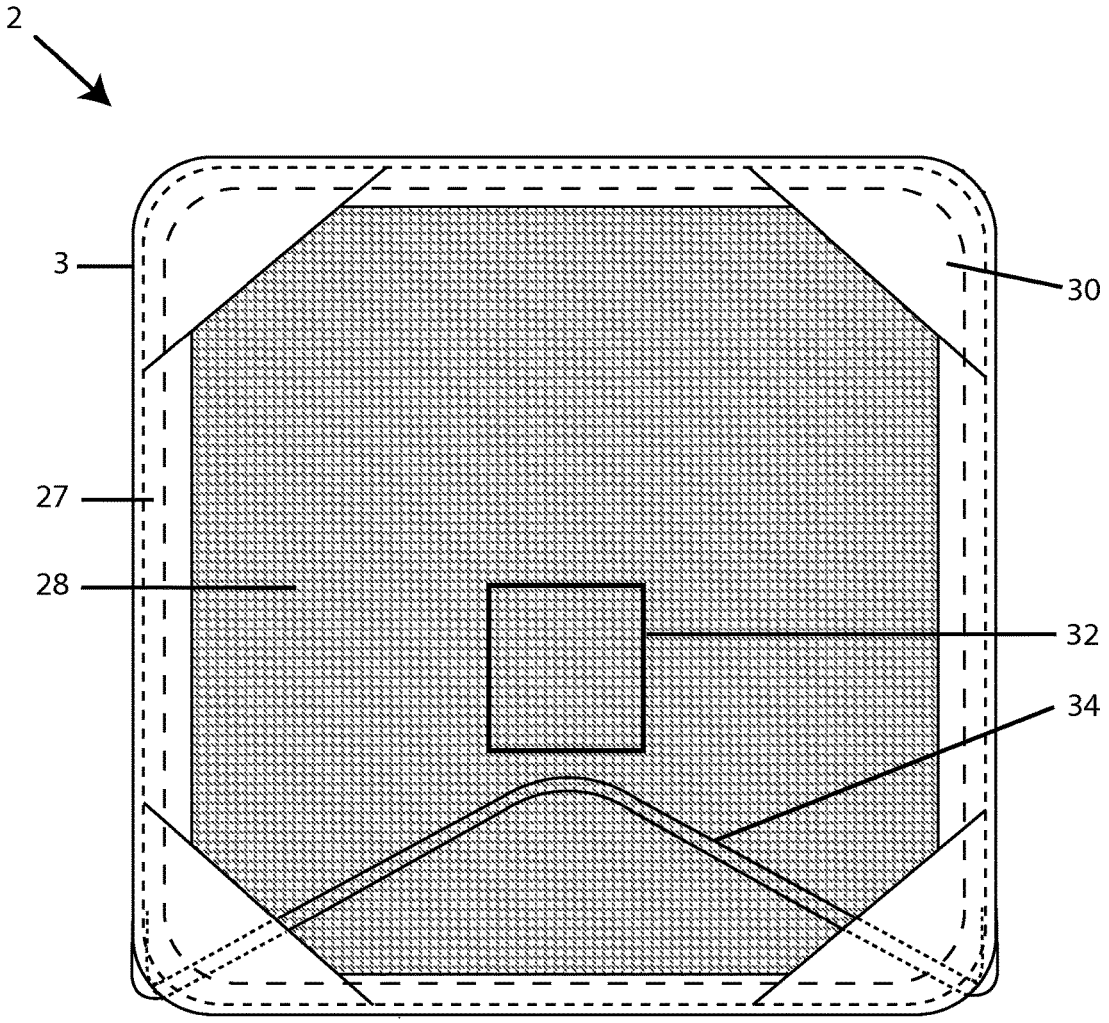
FIG. 2 is a front view of a frame assembly.

Frame Assembly 2 in FIG. 2 illustrates a first sub-assembly which could be referred to as the frame assembly 2. The frame assembly 2 can comprise the following elements: a resilient frame 3, a skirt 27, a barrier 28, at least one corner support 30, a target 32, a base 34, and/or additional features, or less of the features listed in this paragraph if desired.

Exemplary embodiments of the resilient frame 3, the first element of the frame assembly 2, will now be disclosed.

Resilient Frame 3 is illustrated in FIGS. 1-4 & 8-13. In one exemplary embodiment, the resilient frame 3 can be in the unfolded configuration 76, then move to the first folded configuration 78, then move to the second folded configuration 80, and then move to the folded configuration 82. This type of resilient frame 3 coils when folding and then expands open into the unfolded configuration 76 when needed for use.

The resilient frame 3 can be substantially square in shape 26, substantially rectangular in shape, substantially round in shape 25, or in any other configuration that can be coiled for folding. The resilient frame 3 can be made of spring steel, fiberglass rod, or any other suitable resilient material. The size of the resilient frame 3 can range in many different sizes. Some examples would be a 7'×7' square frame, 7'×5' rectangular frame, 7' round frame, 1' frame, a 5' frame, a 9' frame, a 12' frame or any size range that can be satisfactorily coiled for folding. The resilient frame 3 can be configured to be used for tents, for a scrim in photography, a ball net, or any configuration that may use a resilient frame 3. Of course a person of ordinary skill in the art would know a number of ways to make a resilient frame 3 of varying purposes, shapes, sizes, materials, configurations, etc.

Figure 3:
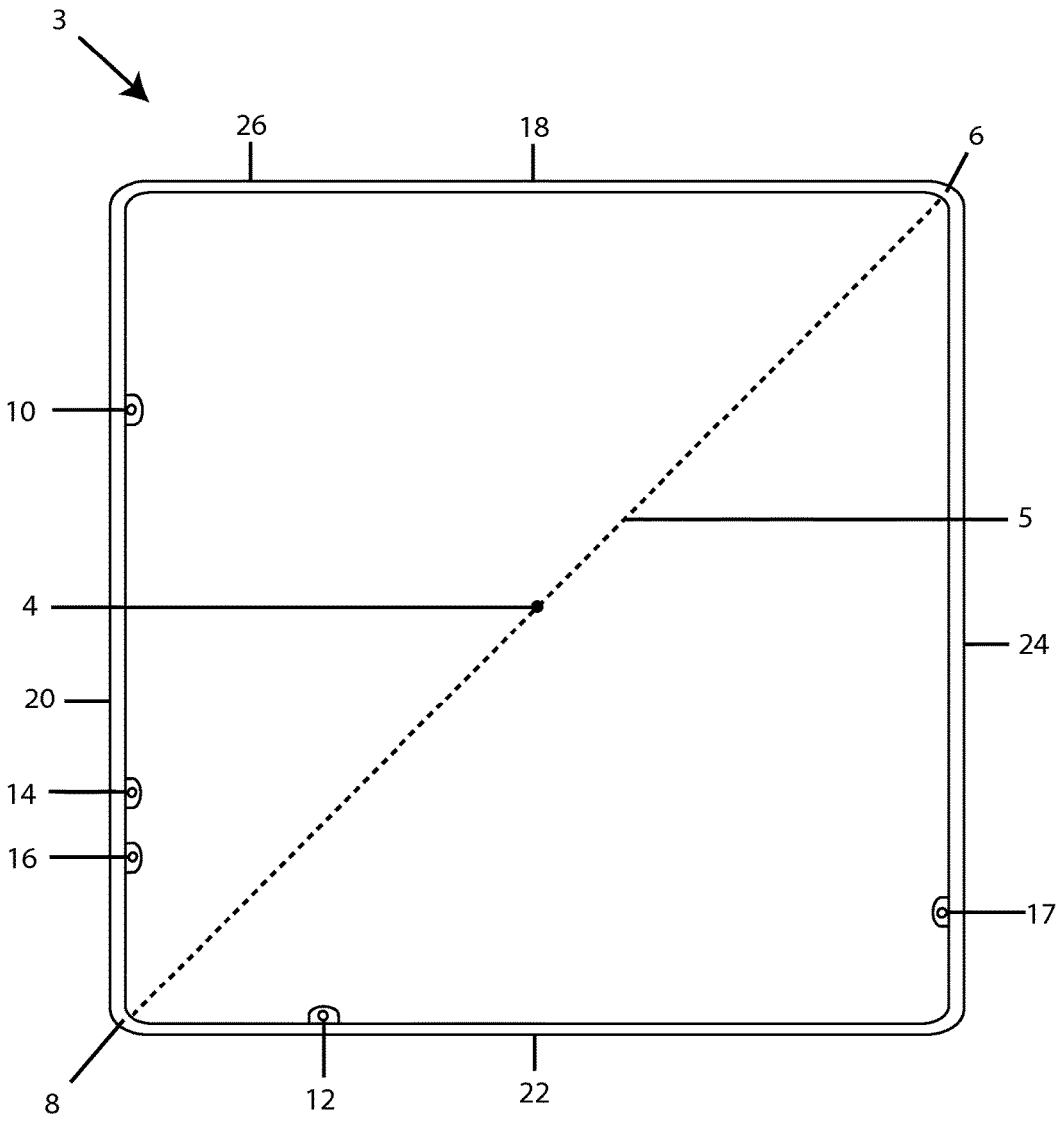
FIG. 3 is a front view of a resilient frame.
Figure 4:
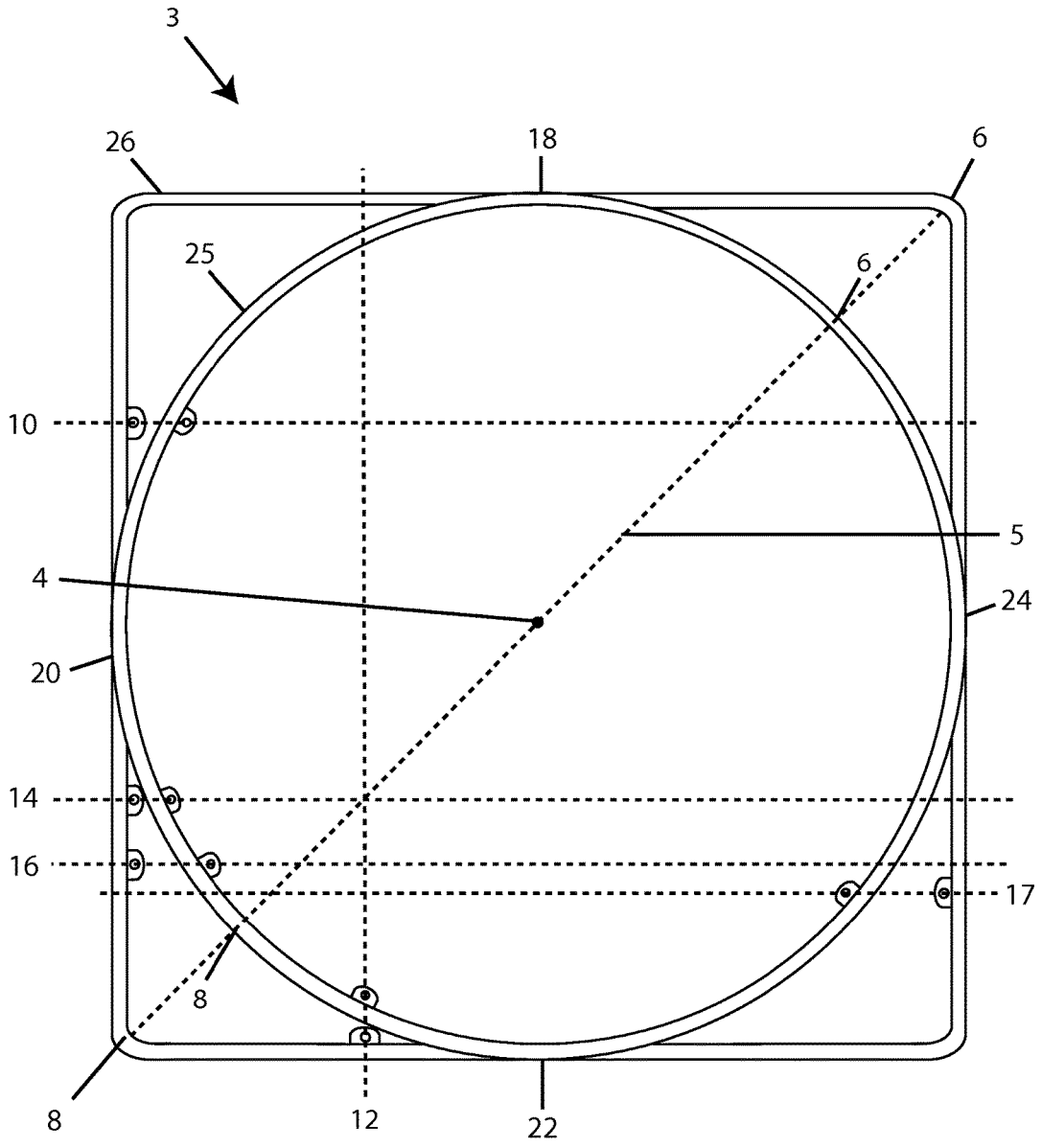
FIG. 4 is a front view of a substantially square in shape resilient frame and a substantially round in shape resilient frame.

Center Point 4 of the Resilient Frame 3 is illustrated in FIGS. 3 & 4. The center point 4 is used for aligning the substantially round 25 resilient frame 3 with the substantially square 26 resilient frame 3 for determining the pre-determined locations of the substantially round 25 resilient frame 3.

Diagonal Line 5 is illustrated in FIGS. 3 & 4 of the resilient frame 3. The diagonal line 5 is defined by drawing an imaginary line from the pre-determined first location 6 located in the upper 18 right 24 corner of the substantially square in shape 26 resilient frame 3 directly to the pre-determined second location 8 located in the lower 22 left 20 corner of the substantially square in shape 26 resilient frame 3. The diagonal line 5 is illustrated for assisting in transferring the pre-determined locations on the substantially square in shape 26 resilient frame 3 to the pre-determined locations on the substantially round in shape 25 resilient frame 3. Also, to help orient and make understanding the locations associated with the resilient frame 3 easier to define.

Upper Side 18, Left Side 20, Lower Side 22, And Right Side 24 are illustrated in FIGS. 3-4, & 10-11. These sides are also illustrated to help orient and make understanding the locations associated with the resilient frame 3 easier to define.

Figure 10:
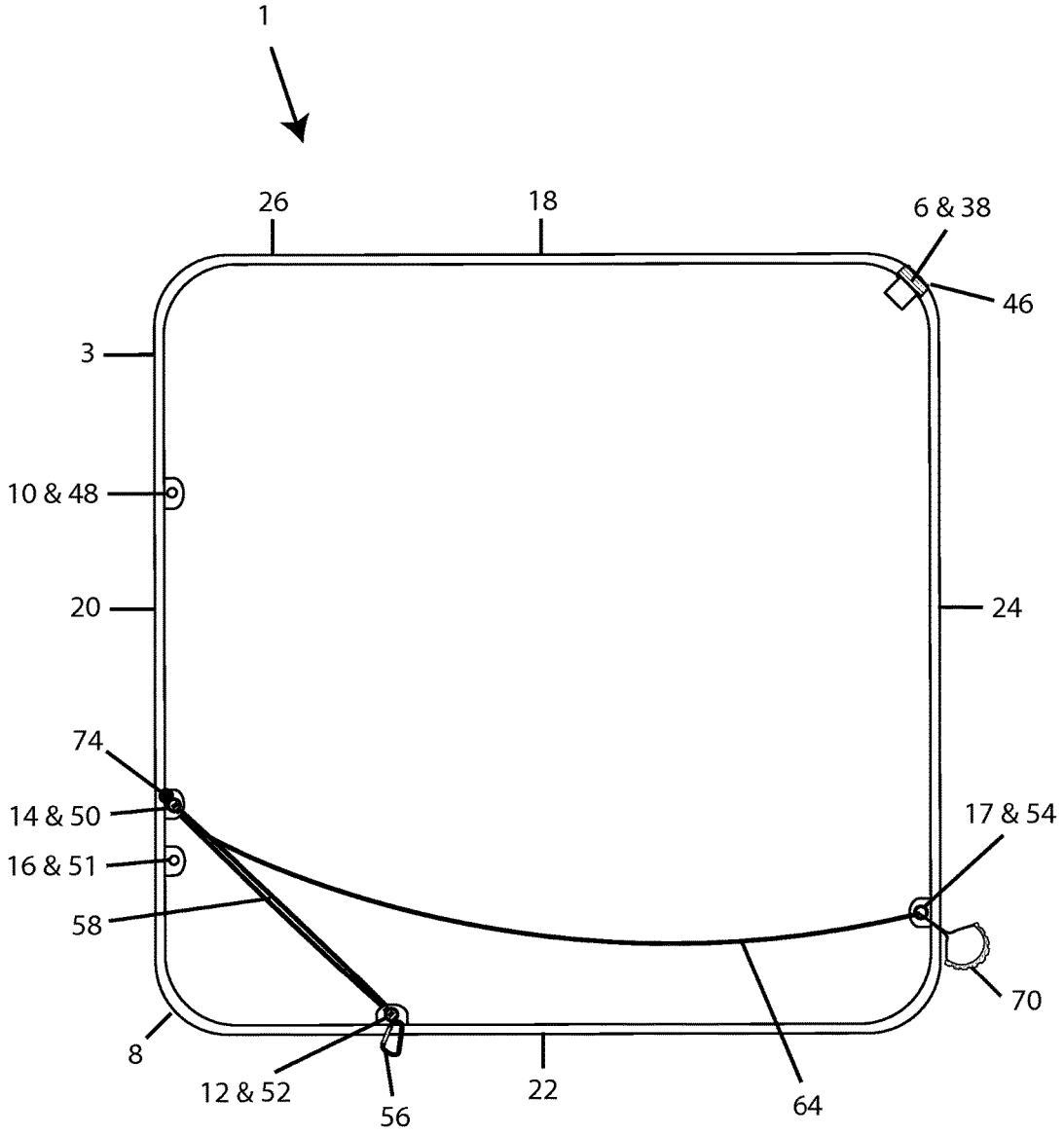
FIG. 10 is a front view of a foldable structure having a portion of a tether and a portion of a restraining member attached to a pre-determined fifth location.
Figure 11:
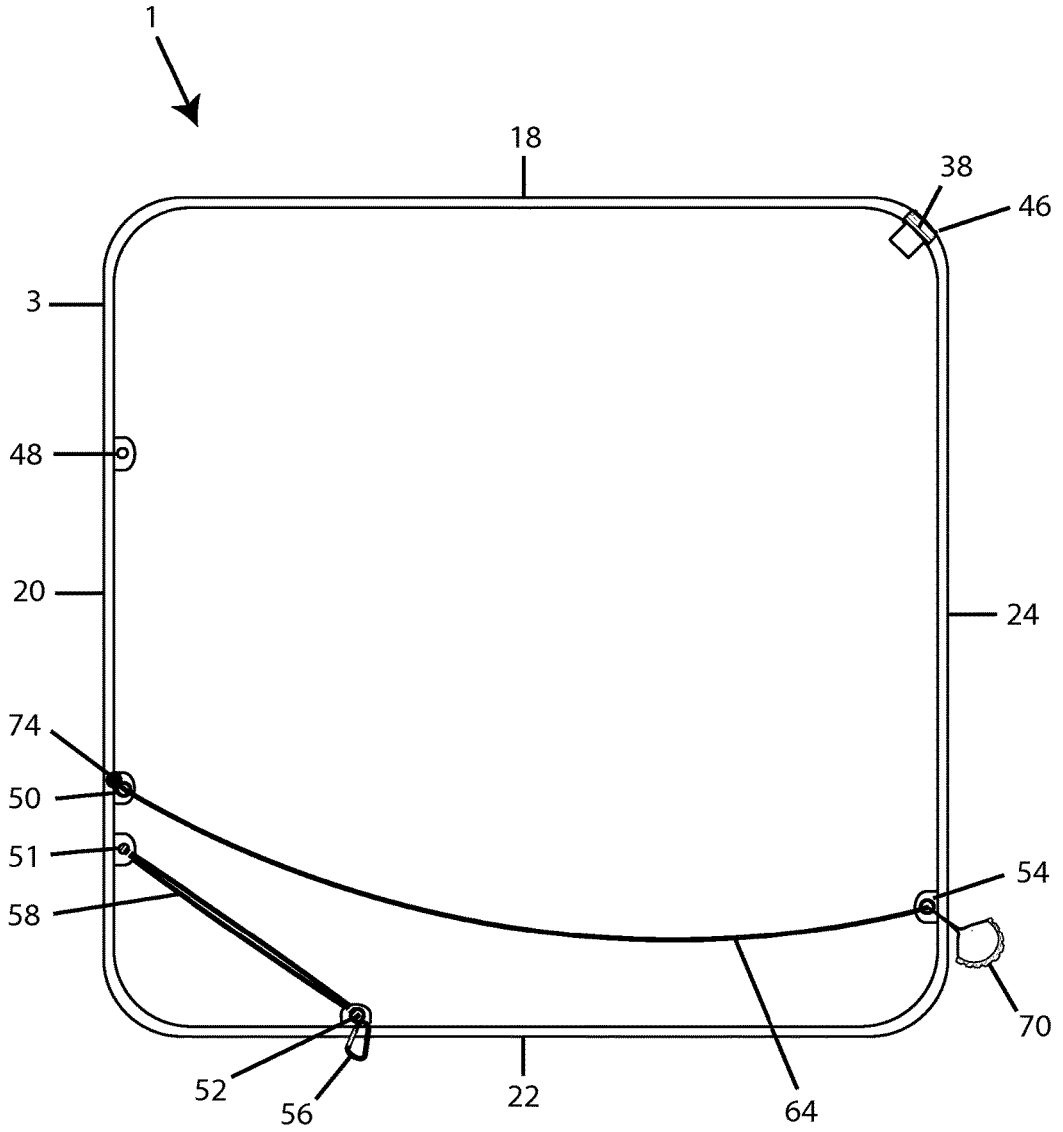
FIG. 11 is a front view of a foldable structure having a portion of a tether attached to a mount and a portion of a restraining member attached to an anchor.
Figure 12:
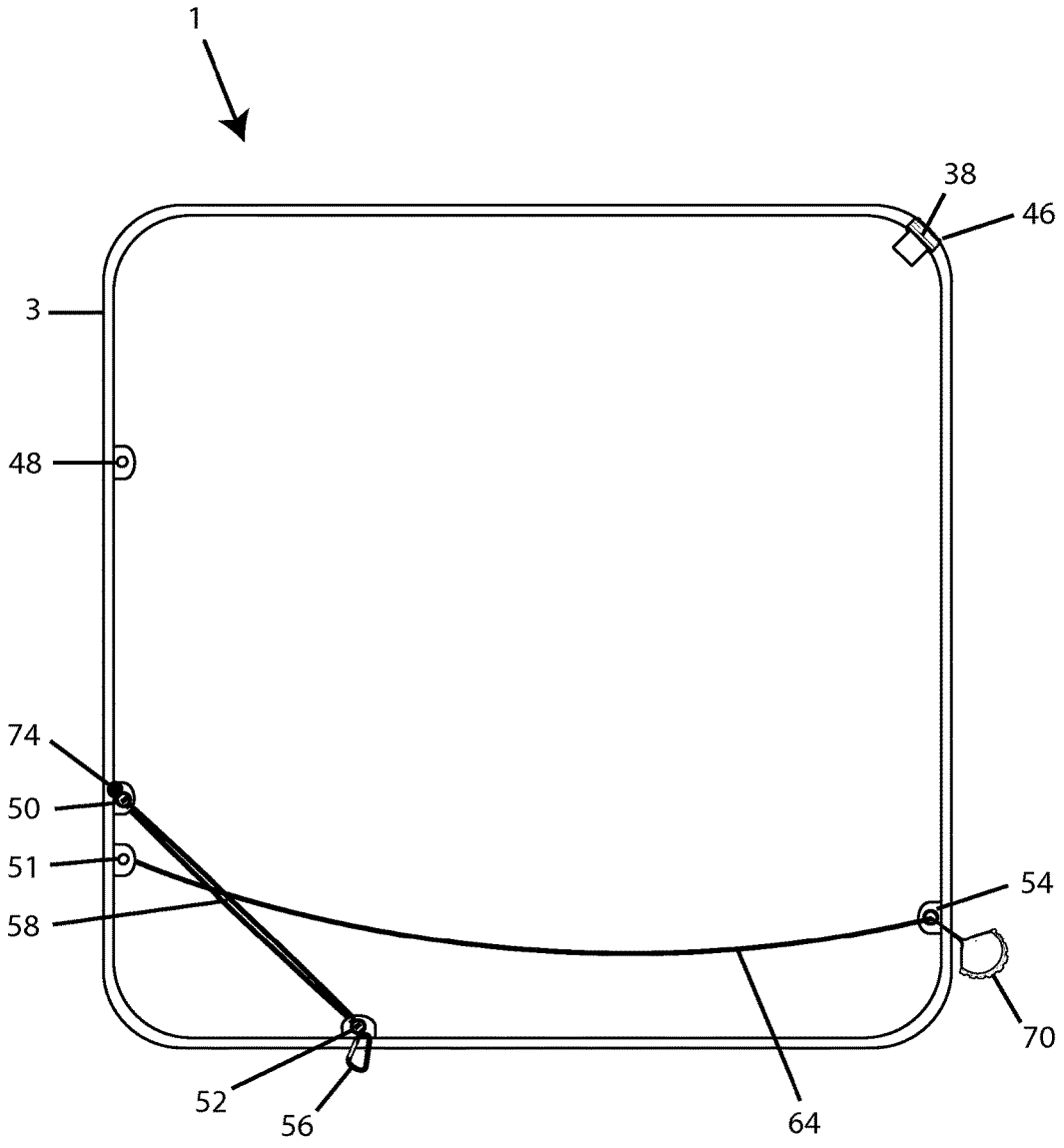
FIG. 12 is a front view of a foldable structure having a portion of a tether attached to an anchor and a portion of a restraining member attached to a mount.

Substantially Square In Shape 26 Resilient Frame 3 is illustrated in FIGS. 3-4 & 10. How to determine and locate the pre-determined locations on the substantially square in shape 26 resilient frame 3 will be disclosed first. Then, in later paragraphs, how to determine and locate the pre-determined locations on the substantially round in shape 25 resilient frame 3 will be disclosed. Based on these descriptions, it should be easy for people of ordinary skill in the art to make other configurations of the resilient frame 3, such as rectangular resilient frames 3 and the like.

Pre-Determined First Location 6 of the Substantially Square In Shape 26 Resilient Frame 3 is illustrated in FIGS. 3-4, 10, & 14-15. The pre-determined first location 6 of the substantially square in shape 26 resilient frame 3 which is located at the upper 18 right 24 side corner of the resilient frame 3.

Pre-Determined Second Location 8 of the Substantially Square In Shape 26 Resilient Frame 3 is illustrated in FIGS. 3-4 & 10. The pre-determined second location 8 of the substantially square in shape 26 resilient frame 3 is diametrically opposed to the pre-determined first location 6 of the substantially square in shape 26 resilient frame 3 and is located at the lower 22 left 20 side corner of the substantially square in shape 26 resilient frame 3.

Pre-Determined Third Location 10 of the Substantially Square In Shape 26 Resilient Frame 3 is illustrated in FIGS. 3-4 & 10. The pre-determined third location 10 of the substantially square in shape 26 resilient frame 3 is located on the vertical plane approximately 22" down from the upper 18 left 20 side of the substantially square in shape 26 resilient frame 3. However, this location can range higher or lower down from the vertical plane of the upper 18 left side 20 of the resilient frame 3.

For example, the pre-determined third location 10 could be 6" down, 12" down, 27" down, or any other acceptable range down the vertical plane starting from the upper 18 left 20 side of the resilient frame 3. This range can be determined by the successful ability of the connection of the latch 48 and the releasable fastener 56 to connect in such a way as to allow the resilient frame 3 to move from the second folding configuration 80 to the folded configuration 82. See FIGS. 17-19.

Pre-Determined Fourth Location 12 of the Substantially Square In Shape 26 Resilient Frame 3 is illustrated in FIGS. 3-4 & 10. The pre-determined fourth location 12 is located approximately 22" in from the lower 22 left 20 side corner of the resilient frame 3 along the horizontal plane. However, this location can range higher or lower along the horizontal plane of the lower 22 left 20 side of the resilient frame 3.

For example, the pre-determined fourth location 12 could be 5" in, 11" in, 26" in, or any other acceptable range in along the horizontal plane starting at the lower 22 left 20 side of the resilient frame 3. This range can be determined by the ability of the connection of the latch 48 and the releasable fastener 56 to connect in such a way as to allow the resilient frame 3 to move from the second folding configuration 80 to the folded configuration 82. See FIGS. 17-19. It can also be determined by the ability of the restraining member 58 to successfully constrain at least a portion of the resilient frame 3 while the resilient frame 3 moves to the first folding configuration 78. See FIGS. 13-15.

Pre-Determined Fifth Location 14 of the Substantially Square In Shape 26 Resilient Frame 3 is illustrated in FIGS. 3-4 & 10. The pre-determined fifth location 14 is located approximately 27" up from the lower 22 left 20 side corner of the resilient frame 3 along the vertical plane. However, this location can range higher or lower along the vertical plane of the lower 22 left 20 side of the resilient frame 3.

For example, the pre-determined fifth location 14 could be 6" up, 12" up, 22" up, or any other acceptable range up the vertical plane starting at the lower 22 left 20 side of the resilient frame 3. This range can be determined by the ability of the restraining member 58 to successfully constrain at least a portion of the resilient frame 3 while the resilient frame 3 moves to the first folding configuration 78. See FIGS. 13-15. It can also be determined by the ability of the tether 64 to move the resilient frame 3 from its second folding configuration 80 to its folded configuration 82 when force is applied to the tether 64. See FIGS. 18-19.

Figure 9:
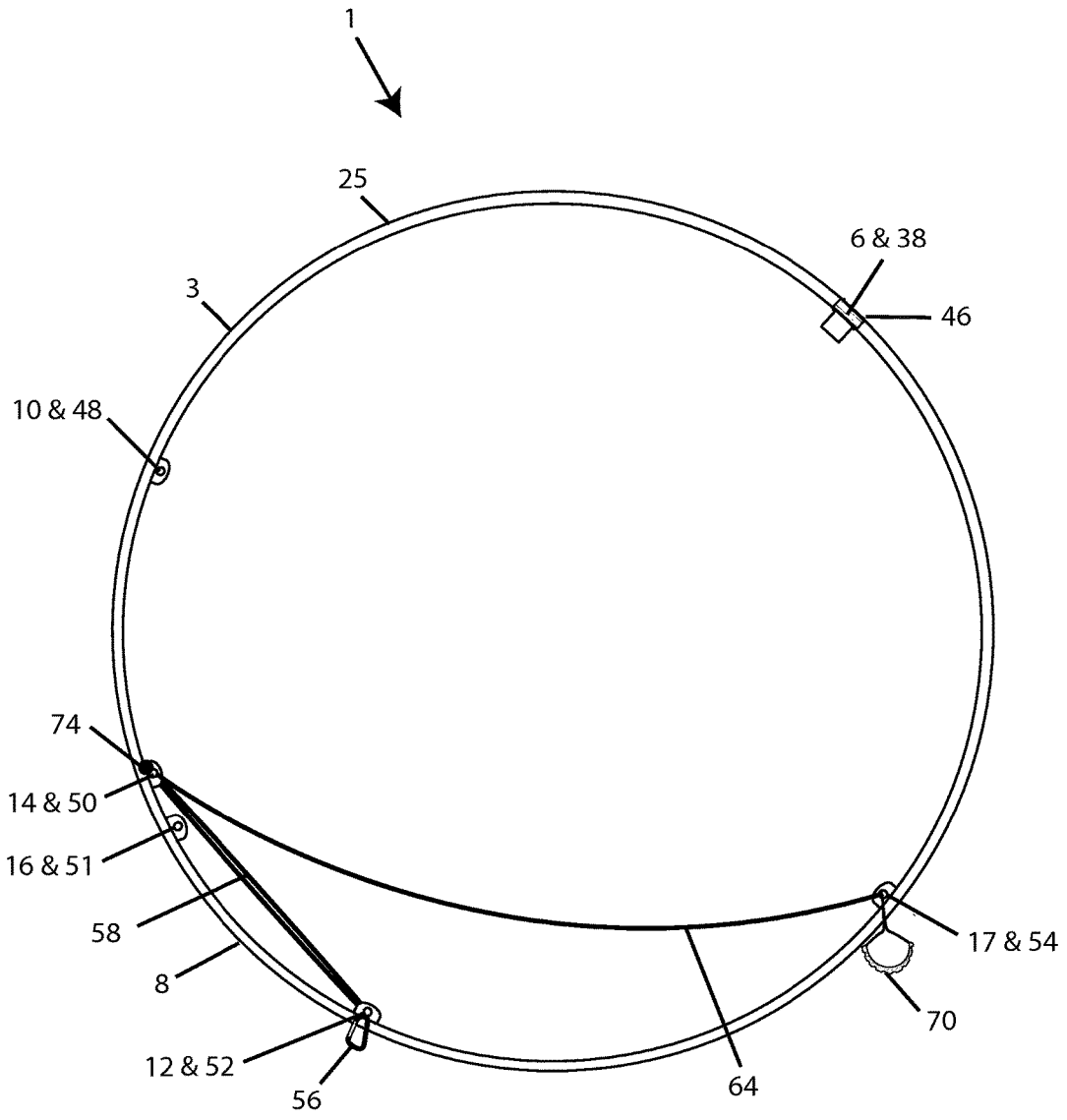
FIG. 9 is a front view of a substantially round in shape foldable structure.

Pre-Determined Sixth Location 16 of the Substantially Square In Shape 26 Resilient Frame 3 is illustrated in FIG. 9. The pre-determined sixth location 16 is located approximately 24" up from the lower 22 left 20 corner side of the resilient frame 3 along the vertical plane. However, this location can range higher or lower along the vertical plane of the lower 22 left 20 side of the resilient frame 3.

For example, the pre-determined sixth location 16 could be 6" up, 12" up, 22" up, or any other acceptable range up the vertical plane starting at the lower 22 left 20 side of the resilient frame 3. The pre-determined sixth location 16 is below the pre-determined fifth location 14.

This location range can be determined by the ability of the restraining member 58 to successfully constrain at least a portion of the resilient frame 3 while the resilient frame 3 moves to the first folding configuration 78. See FIGS. 13-16. It can also be determined by the ability of the tether 64 to move the resilient frame 3 from its second folding configuration 80 to its folded configuration 82 when force is applied to the tether 64. See FIGS. 18-19.

Pre-Determined Seventh Location 17 of the Substantially Square In Shape 26 Resilient Frame 3 is illustrated in FIGS. 3-4 & 10. The pre-determined seventh location 17 is located approximately 10" up from the lower 22 right 24 side of the resilient frame 3 along the vertical plane. However, this location can range higher or lower along the vertical plane of the lower 22 right 24 side of the resilient frame 3.

For example, the pre-determined seventh location 17 could be 6" up, 12" up, 22" up, or any other acceptable range up the vertical plane starting at the lower 22 right 24 side of the resilient frame 3. This range can be determined by the ability of the tether 64 to move the resilient frame 3 from its second folding configuration 80 to its folded configuration 82 when force is applied to the tether 64. See FIGS. 18-19.

Substantially Round In Shape 25 Resilient Frame 3 is illustrated in FIGS. 4 & 9. Listed below are the following steps you can use to define the pre-determined first location 6, pre-determined second location 8, pre-determined third location 10, pre-determined fourth location 12, pre-determined fifth location 14, pre-determined sixth location 16, and the pre-determined seventh location 17 of the substantially round in shape 25 resilient frame 3.

FIG. 10 outlines the following steps, listed below, to define the pre-determined locations on the substantially round in shape 25 resilient frame 3.

STEP 1. Refer to the substantially square in shape 26 resilient frame 3, disclosed above, and recognize its dimensions. In this example, the size of the square 26 resilient frame 3 will measure 7'×7'.

STEP 2. Create a substantially round in shape 25 resilient frame 3 having a diameter of 7'. This diameter matches the horizontal or vertical dimension of the substantially square in shape 26 resilient frame 3.

STEP 3. Place the square 26 resilient frame 3 flat on a surface. Orient the pre-determined first location 6 of the square 26 resilient frame 3 to be at the upper 18 right 24 side corner. Then orient the pre-determined second location 8 of the square 26 resilient frame 3 to be at the lower 22 left 20 side corner of the resilient frame 3. The diagonal line 5 should be running down from the pre-determined first location 6 to the predetermined second location 8 of the resilient frame 3.

STEP 4. Place the substantially round in shape 25 resilient frame 3 on top of the substantially square in shape 26 resilient frame 3.

STEP 5. Align the center point 4 of the square 26 resilient frame 3 with the center point 4 of the round 25 resilient frame 3. See FIG. 4.

STEP 6. Pre-Determined First Location 6 of the Substantially Round In Shape 25 Resilient Frame 3 is approximately located where the diagonal line 5 intersects with the upper 18 right 24 side of the substantially round in shape 25 resilient frame 3. See FIG. 4.

STEP 7. Pre-Determined Second Location 8 of the Substantially Round In Shape 25 Resilient Frame 3 is approximately located where the diagonal line 5 intersects with the lower 22 left 20 side of the substantially round in shape 25 resilient frame 3.

STEP 8. Create an imaginary horizontal line that runs through the pre-determined third location 10 of the substantially square in shape 26 resilient frame 3.

STEP 9. Pre-Determined Third Location 10 of the Substantially Round In Shape 25 Resilient Frame 3 is created by locating where the imaginary horizontal line, defined in STEP 8 above, intersects the left side 20 of the substantially round in shape 25 resilient frame 3. See FIG. 4.

STEP 10. Create an imaginary horizontal line that runs through the pre-determined fifth location 14 of the substantially square in shape 26 resilient frame 3.

STEP 11. Pre-Determined Fifth Location 14 of the Substantially Round In Shape 25 Resilient Frame 3 is created by locating where the imaginary horizontal line, defined in STEP 10 above, intersects the left side 20 of the substantially round in shape 25 resilient frame 3.

STEP 12. Create an imaginary horizontal line that runs through the pre-determined sixth location 16 of the substantially square in shape 26 resilient frame 3.

STEP 13. Pre-Determined Sixth Location 16 of the Substantially Round in Shape 25 Resilient Frame 3 is created by locating where the imaginary horizontal line, defined in STEP 12 above, intersects the left side 20 of the substantially round in shape 25 resilient frame 3.

STEP 14. Create an imaginary horizontal line that runs through the pre-determined seventh location 17 of the substantially square in shape 26 resilient frame 3.

STEP 15. Pre-Determined Seventh Location 17 of the Substantially Round in Shape 25 Resilient Frame 3 is created by locating where the imaginary horizontal line, defined in Step 14 above, intersects the right side 24 of the substantially round in shape 25 resilient frame 3.

STEP 16. Create an imaginary vertical line that runs through the pre-determined fourth location 12 of the substantially square in shape 26 resilient frame 3.

STEP 17. Pre-Determined Fourth Location 12 of the Substantially Round In Shape 25 Resilient Frame 3 is created by locating where the imaginary vertical line, defined in STEP 16 above, intersects the lower side 22 of the substantially round in shape 25 resilient frame 3.

Pre-Determined Orientations And Locations of the Resilient Frame 3 Which Varies In Shapes and Sizes Not Defined Above. Of course a person of ordinary skill in the art would know a number of ways to define and locate the pre-determined locations, defined above, on a resilient frame 3 that varies in different shapes and sizes. These locations can provide support for attaching the coiling-assist assembly 36 to the resilient frame 3.

Exemplary embodiments of the skirt 27, the next optional element of the frame assembly 2, will now be disclosed.

Skirt 27 is illustrated in FIGS. 1 & 2. The skirt 27 can act as a coupler for the resilient frame 3 by allowing the barrier 28 and/or other objects to couple to the skirt 27 while the skirt 27 couples to the resilient frame 3.

In one exemplary embodiment, the skirt 27 is made of material, such as nylon, cotton, or the like. One way to create a skirt 27 is to cut the preferred material approximately 3-12" wide, fold the 3-12" skirt 27 in half, and wrap the skirt 27 around the circumference of the resilient frame 3 so the resilient frame 3 is fully enclosed in the skirt 27. Then sew the wrapped edges of the skirt 27 together creating a pocket in the skirt 27. In this example, the resilient frame 3 is fully enclosed in the pocket of the skirt 27. The skirt 27 can be 1" wide or wider, such as 12" wide, so a decal, logo, or advertisement can be printed on the skirt 27.

In yet another exemplary embodiment, the skirt 27, can be as simple as a metal, plastic, or other suitable type of material that forms a ring. In this configuration you can use a ring or a number of rings which can slide over the resilient frame 3. These ring skirts 27 provide yet another way for objects to be coupled to the resilient frame 3. Of course a person of ordinary skill in the art would know a number of ways to make a skirt 27 of many different sizes, shapes, materials, and configurations for coupling to the resilient frame 3.

Exemplary embodiments of the barrier 28, the next optional element of the frame assembly 2, will now be disclosed.

Barrier 28 is illustrated in FIGS. 1 & 2. The barrier 28 that can be coupled to the resilient frame 3 or to the skirt 27. The barrier 28 can be made of netting for stopping a ball or caging a bird, made of scrim material for blocking or reducing the sun for use in photography or video shooting, made of other materials such as nylon, cotton, or the like for making tents, sun shades, umbrellas, etc. Of course other types of materials can be used as a barrier 28 for coupling to resilient frames 3.

In another exemplary embodiment, the barrier 28 can be coupled to the skirt 27 and to the resilient frame 3, or coupled to other objects as well. To couple the barrier 28 to the skirt 27, follow the steps above for creating a material skirt 27, but before sewing the skirt 27 together, sandwich the barrier 28 between the two folded over sections of the skirt 27. Then sew the skirt 27 together. This exemplary embodiment allows the skirt 27 to act as the coupler for attaching the barrier 28 to the resilient frame 3.

In yet another exemplary embodiment, you can weave individual rings acting as skirts 27 in sections of a net that acts as the barrier 28. You can use the ring skirts 27 to couple the barrier 28 to the resilient frame 3. Of course a person of ordinary skill in the art would know a number of ways to make a barrier 28 of many different sizes, shapes, materials, and configurations.

Exemplary embodiments of the at least one corner support 30, the next optional element of the frame assembly 2, will now be disclosed.

At Least One Corner Support 30 is illustrated in FIGS. 1 & 2. The at least one corner support 30 can be coupled in at least one of the corners of most non-circular resilient frames 3. The at least one corner support 30 may be used for helping support the form of most non-circular resilient frames 3. For any shaped resilient frames 3, you can use the at least one corner support 30 for printing advertising, logos, banners, and the like. Materials such as nylon, cotton, and the like may be used.

For example, at least one corner support 30 can help pull and support a corner that has been formed out of a resilient material such as spring steel, fiberglass or the like. The at least one corner support 30 can help support and maintain the formed corner so the resilient frame 3 stays in a substantially rectangular or substantially square in shape 26 configuration. The at least one corner support 30 can also act as a place to print a logo, advertisement, or banner. Of course a person of ordinary skill in the art would know a number of ways to make at least one corner support 30 of many different shapes, sizes, materials, and configurations.

Exemplary embodiments of the target 32, the next optional element of the frame assembly 2, will now be disclosed.

Target 32 is illustrated in FIGS. 1 & 2. The target 32 that can be coupled to the barrier 28 to provide a target 32 for aiming at when throwing a ball or for locating a specific place on the barrier 28. Of course a person of ordinary skill in the art would know a number of ways to make a target 32 of many different shapes, sizes, materials, and configurations.

Exemplary embodiments of the base 34, the next optional element of the frame assembly 2, will now be disclosed.

Base 34 is illustrated in FIGS. 1 & 2. A base 34 may be coupled to the resilient frame 3 for supporting the resilient frame 3 in a substantially upright position and/or at an angled position depending on the angle desired for the resilient frame 3.

In one exemplary embodiment, the base 34 is a second resilient frame 3 for supporting the first resilient frame 3 in a substantially upright and/or angled position. In one embodiment, sewing the two resilient frames 3 together at a specified point could be a way of coupling the two resilient frames 3 together.

In yet another exemplary embodiment, a tubular base 34 could be coupled to the resilient frame 3. The tubular base 34 could be formed in a t-shape, a u-shape, or any other kind of fabricated configuration that could support the resilient frame 3 in a substantially upright and/or angled position. Of course a person of ordinary skill in the art would know a number of ways to couple the resilient frame 3 to the base 34 and to make a base 34 of many different shapes, sizes, materials, and configurations to support the resilient frame 3.

The Exemplary embodiments of the coiling-assist assembly 36, the second sub-assembly, will now be disclosed.

Figure 5:
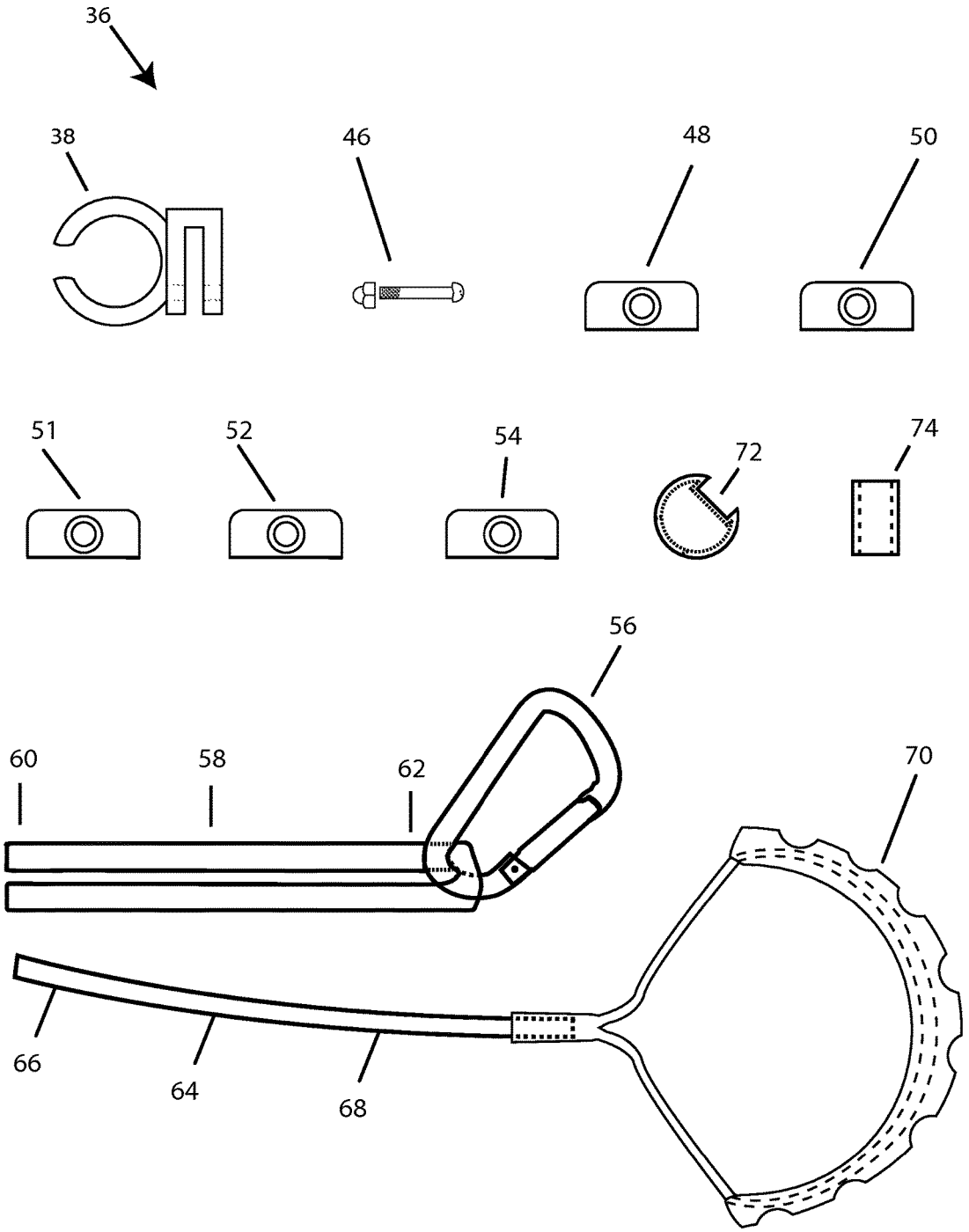
FIG. 5 includes illustrations of components of a coiling-assist assembly.

Coiling-Assist Assembly 36 in FIG. 5 illustrates a second sub-assembly. The coiling-assist assembly 36 can comprise a releasable grasp 38, at least one adhering member 46, a latch 48, a mount 50, an anchor 51, a slip member 52, a glide member 54, a releasable fastener 56, a restraining member 58, a tether 64 with a handle 70, a cover 72, a stopper 74, and/or additional features, or less of the features listed above in this paragraph if desired. For example, the coiling-assist assembly 36 can comprise of the releasable grasp 38 only.

The coiling-assist assembly 36 can couple with the frame assembly 2 or to the resilient frame 3 only. The coiling-assist assembly 36 facilitates coiling the resilient frame 3 while folding.

Exemplary embodiments of the releasable grasp 38, the first element of the coiling-assist assembly 36, will now be disclosed.

Releasable Grasp 38 is illustrated in FIGS. 1 & 5-19. The releasable grasp 38 is coupled to the resilient frame 3 at the pre-determined first location 6. Coupling methods may include glue, bolts and nuts, rivets, Velcro, or any acceptable means for securing the releasable grasp 38 to the resilient frame 3.

Figure 6:
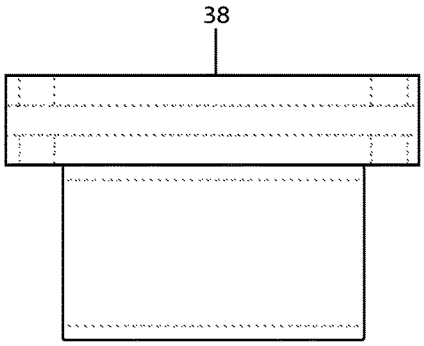
FIG. 6 is a top view of a releasable grasp.
Figure 7:
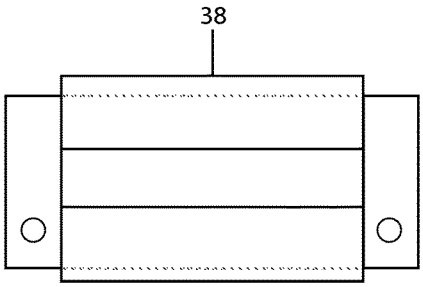
FIG. 7 is a front view of a releasable grasp.

FIG. 5 shows a right side view of the releasable grasp 38. FIG. 6 is a top view of the releasable grasp 38. FIG. 7 is a front view of the releasable grasp 38. FIGS. 8A-8D are right side views of the releasable grasp 38.

In one exemplary embodiment, the releasable grasp 38 expands when force is applied to the releasable grasp 38 by a portion of the resilient frame 3. The releasable grasp 38 accepts and temporarily holds a portion of the resilient frame 3 and then expands to release the resilient frame 3 when the resilient frame 3 applies force in the opposite direction to the void 41 in the releasable grasp 38. The force may be applied to the resilient frame 3 by a human directly or indirectly by a human or mechanical means such as a motor, applying force to the tether 64 which in turn applies force to the resilient frame 3.

For example, when moving the resilient frame 3 from the unfolded configuration 76 to the first folding configuration 78, a section of the resilient frame 3 can be forcibly inserted through the void 41 of the releasable grasp 38. This causes the c-shaped section 40 to expand open and let the resilient frame 3 rest in the center of the c-shaped section 40. Then when the resilient frame 3 is moving from the second folding configuration 80 to the folded configuration 82, a reverse force is applied to the resilient frame 3 causing the c-shaped section 40 to open and release the resilient frame 3 from the c-shaped section 40 of the releasable grasp 38. A human or other mechanism, such as a motor or the like, may apply force to the tether 64 and the tether may apply force to the resilient frame 3 causing the c-shaped section 40 of the releasable grasp 38 to expand open allowing the resilient frame 3 to be released from the releasable grasp 38.

The releasable grasp 38 can be molded out of plastic, cast out of aluminum, fabricated out of steel, wood, or any other type of material suitable for fabricating the releasable grasp 38.

Other exemplary embodiments of the releasable grasp 38 are available. For example, Velcro could act as the releasable grasp 38. The hook of the Velcro could be attached to the pre-determined first location 6 of the resilient frame 3 and the loop of the Velcro could be attached to the pre-determined second location 8 of the resilient frame 3. To secure the resilient frame 3 together, you would attach the Velcro together, and in this example, the Velcro would act as the releasable grasp 38. To release the resilient frame 3, simply apply force and pull the resilient frame 3 apart. This would cause the Velcro to release, thus releasing the resilient frame 3 from being held.

One of the functions of the releasable grasp 38 is to temporarily hold the resilient frame 3 while moving from the first folding configuration 78 to the second folding configuration 80, and then release the resilient frame 3 when moving from the second folding configuration 80 to the folded configuration 82. There are several other exemplary embodiments that could be used as a releasable grasp 38 such as two opposing magnets, an L-shaped hook, a snap, or the like.

Figure 8A:
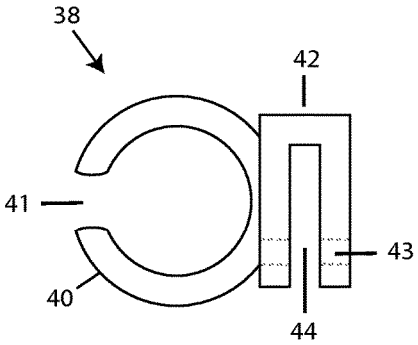
FIG. 8A is a right side view of a releasable grasp.
Figure 8B:
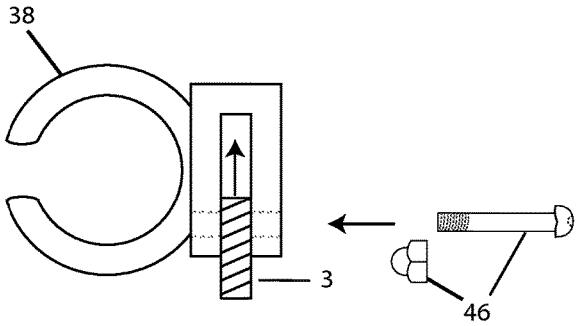
FIG. 8B is a right side view of a releasable grasp and a resilient frame.
Figure 8C:
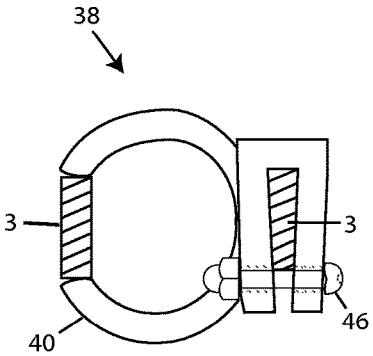
FIG. 8C is a right side view of a resilient frame expanding the releasable grasp.
Figure 8D:
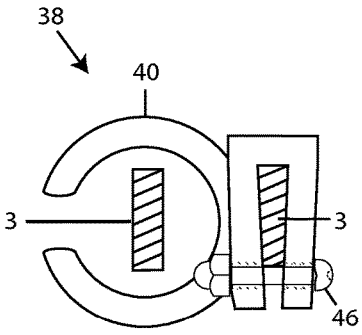
FIG. 8D is a right side view of a releasable grasp temporarily holding a resilient frame.

Referring to FIG. 8A. The releasable grasp 38 includes a c-shaped section 40, a void 41, a securement member 42, an affixing member 43, and/or an inverted u-shaped lip 44.

C-Shaped Section 40 of the Releasable Grasp 38 is illustrated in FIGS. 8A-8D. The c-shaped section 40 is a sub-element of the releasable grasp 38.

In one exemplary embodiment, the c-shaped section 40 expands open when a section of the resilient frame 3 is forced through the void 41 of the releasable grasp 38. The c-shaped section 40 then contracts back into its original position temporarily holding the resilient frame 3 in the jaws of the c-shaped section 40. Then, to release the resilient frame 3 from the c-shaped section 40, a reverse force actuated by a tether 64, human, or other force means is applied to a section of the resilient frame 3. The resilient frame 3 is then pulled out through the void 41 causing the c-shaped section 40 to expand open. This allows the resilient frame 3 to be released from the c-shaped section 40. After releasing the resilient frame 3, the c-shaped section 40 then contracts and returns back to its original resting position.

Void 41 is illustrated in FIG. 8A. The void 41 is a sub-element of the releasable grasp 38 and allows a portion of the resilient frame 3 to enter and exit the releasable grasp 38.

Securement Member 42 is illustrated in FIG. 8A. The securement member 42 is a sub-element of the releasable grasp 38. The securement member 42 provides a way for connecting the releasable grasp 38 to the resilient frame 3. The inverted u-shaped lip 44 has a hollow section sandwiched between two attachment sides. The inverted u-shaped lip 44 slides down over a section of the resilient frame 3. The inverted u-shaped lip 44 extends past the height of the resilient frame 3. This allows an affixing member 43 to be inserted through the inverted u-shaped lip 44. Once inserted, the affixing member 43 can be tightened to sandwich a section of the resilient frame 3 between the inverted u-shaped lip 44. Because the inverted u-shaped lip 44 extends past the height of the resilient frame 3, the need to drill a hole through the resilient frame 3 for attaching the releasable grasp 38 may be eliminated.

Affixing Member 43 is illustrated in FIG. 8A. The affixing member 43 is a sub-assembly of the releasable grasp 38. In one exemplary embodiment, the affixing member 43 is at least one hole that goes through the securement member 42.

Inverted U-Shaped Lip 44 is illustrated in FIG. 8A. In one exemplary embodiment, the inverted u-shaped lip 44 is a sub-assembly of the releasable grasp 38 and is used for coupling the releasable grasp 38 to the pre-determined first location 6 of the resilient frame 3.

Adhering Member 46 is illustrated in FIGS. 1, 5, & 8A-13. In one exemplary embodiment, the adhering member 46 secures the releasable grasp 38 to the pre-determined first location 6 of the resilient frame 3. The adhering member 46 can be a bolt and nut, a rivet, glue, Velcro, or any other satisfactory means for securing the releasable grasp 38 to the pre-determined first location 6 of the resilient frame 3.

Latch 48 is illustrated in FIGS. 1, 5, & 9-19. In one exemplary embodiment, the latch 48 is coupled to the resilient frame 3 at the pre-determined third location 10 of the resilient frame 3. In another exemplary embodiment, the latch 48 is coupled to the skirt 27 at the pre-determined third location 10 of the resilient frame 3.

The latch 48 couples with the releasable fastener 56 for holding the resilient frame 3 in the second folding configuration 80 of the resilient frame 3. In one exemplary embodiment, the latch 48 is an eyelet attached to the skirt 27 at the pre-determined third location 10.

In another exemplary embodiment, the latch 48 is a hole drilled in the frame at the pre-determined third location 10. Other exemplary embodiments may include one side of a piece of Velcro, in this example the hook side, and the releasable fastener 56 could be the loop side of the Velcro. The latch 48 could be a snap, one side of two opposing magnets (the other side of the magnet would act as the releasable fastener 56), an L-shaped hook, a loop, or the like. Of course, a person of ordinary skill in the art would know a number of ways to create a latch 48.

Mount 50 is illustrated in FIGS. 1, 5, & 9-19. In one exemplary embodiment, the mount 50 is coupled to the resilient frame 3 at the pre-determined fifth location 14 of the resilient frame 3. In another exemplary embodiment, the mount 50 is coupled to the skirt 27 at the pre-determined fifth location 14 of the resilient frame 3.

The mount 50 may couple with the first end 66 of the tether 64 and the proximal end 60 of the restraining member 58, or couple with the first end 66 of the tether 64 only, or couple with the proximal end 60 of the restraining member 58 only.

One exemplary way to couple the first end 66 of the tether 64 and/or the proximal end 60 of the restraining member 58 to the mount 50 is to slide the first end 66 of the tether 64 and/or the proximal end 60 of the restraining member 58 through the mount 50. Then slide the cover 72 over the tether 64 and/or the restraining member 58. Then tie the first end 66 of the tether 64 and/or the proximal end 60 of the restraining member 58 together in a knot. The cover 72 covers the knot and makes the knot look aesthetically pleasing to the eye. The knot acts as a stopper 74 for keeping the first end 66 of the tether 64 and/or the proximal end 60 of the restraining member 58 coupled to the mount 50.

In one exemplary embodiment, the mount 50 is an eyelet attached to the skirt 27 at the pre-determined fifth location 14 of the resilient frame 3. In another exemplary embodiment, the mount 50 is a hole drilled in the resilient frame 3 at the pre-determined fifth location 14. Of course, a person of ordinary skill in the art would know a number of ways to create a mount 50.

Anchor 51 is illustrated in FIGS. 1, 5 & 9-13. In one exemplary embodiment, the Anchor 51 is coupled to the resilient frame 3 at the pre-determined sixth location 16 of the resilient frame 3. In another exemplary embodiment, the anchor 51 is coupled to the skirt 27 at the pre-determined sixth location 16 of the resilient frame 3.

The anchor 51 may couple with the first end 66 of the tether 64 and/or the proximal end 60 of the restraining member 58, or couple with the first end 66 of the tether 64 only, or couple with the proximal end 60 of the restraining member 58 only.

One exemplary way to couple the first end 66 of the tether 64 and/or the proximal end 60 of the restraining member 58 to the anchor 51 is to slide the first end 66 of the tether 64 and the proximal end 60 of the restraining member 58 through the anchor 51. Then slide the cover 72 over the tether 64 and/or the restraining member 58. Then tie the first end 66 of the tether 64 and/or the proximal end 60 of the restraining member 58 together in a knot. The cover 72 covers the knot and makes the knot look aesthetically pleasing to the eye. The knot acts as a stopper 74 for keeping the first end 66 of the tether 64 and/or the proximal end 60 of the restraining member 58 coupled to the anchor 51.

In one exemplary embodiment, the anchor 51 is an eyelet attached to the skirt 27 at the pre-determined sixth location 16 of the resilient frame 3. In another exemplary embodiment, the anchor 51 is a hole drilled in the resilient frame 3 at the pre-determined sixth location 16. Of course, a person of ordinary skill in the art would know a number of ways to create an anchor 51.

Slip Member 52 is illustrated in FIGS. 1, 5, & 9-19. In one exemplary embodiment, the slip member 52 is coupled to the resilient frame 3 at the pre-determined fourth location 12 of the resilient frame 3. In another exemplary embodiment, the slip member 52 is coupled to the skirt 27 at the pre-determined fourth location 12 of the resilient frame 3.

In one exemplary embodiment, the slip member 52 is an eyelet attached to the skirt 27 at the pre-determined fourth location 12 of the resilient frame 3. In another exemplary embodiment, the slip member 52 is a hole drilled in the resilient frame 3 at the pre-determined fourth location 12. The slip member 52 may also create a slidable coupler for the distal end 62 of the restraining member 58. Of course, a person of ordinary skill in the art would know a number of ways to create a slip member 52.

Glide Member 54 is illustrated in FIGS. 1, 5, & 9-19. In one exemplary embodiment, the glide member 54 is coupled to the resilient frame 3 at the pre-determined seventh location 17 of the resilient frame 3. In another exemplary embodiment, the glide member 54 is coupled to the skirt 27 at the pre-determined seventh location 17 of the resilient frame 3.

In one exemplary embodiment, the glide member 54 is an eyelet attached to the skirt 27 at the pre-determined seventh location 17 of the resilient frame 3. In another exemplary embodiment, the glide member 54 is a hole drilled in the resilient frame 3 at the pre-determined seventh location 17. The glide member 54 may also create a slidable coupler for the second end 68 of the tether 64. Of course, a person of ordinary skill in the art would know a number of ways to create a glide member 54.

Releasable Fastener 56 is illustrated in FIGS. 1, 5, & 9-19. The releasable fastener 56 releasably couples with the latch 48 for holding the resilient frame 3 in the second folding configuration 80 of the resilient frame 3. The releasable fastener 56 also couples with the slip member 52 at the pre-determined fourth location 12.

In one exemplary embodiment, the releasable fastener 56 is a carabineer, a fastener climbers use for climbing. Other exemplary embodiments of the releasable fastener 56 may include one side of a piece of Velcro, in this example the hook side, and the latch 48 could be the loop side of the Velcro it could also be used in the opposite way having the hook and loop of the Velcro reversed. The releasable fastener 56 could be a snap, one side of two opposing magnets (the other side of the magnet would act as the latch 48), an L-shaped hook, an s-hook, or other types of releasable fasteners 56 could be used. Of course, a person of ordinary skill in the art would know a number of ways to create a releasable fastener 56.

Restraining Member 58 is illustrated in FIGS. 1, 5, & 9-19. In one exemplary embodiment, the proximal end 60 of the restraining member 58 couples to the mount 50 while the distal end 62 of the restraining member 58 slidably couples with the slip member 52. To create and couple the restraining member 58 to the resilient frame 3 the following steps may be followed.

STEP 1. The material for the restraining member 58 may be a piece of bungee cord or other material types, elastic or inelastic. The material type, size, and diameter may vary in any range as long as the restraining member 58 can successfully constrain at least a portion of the resilient frame 3 while the resilient frame 3 moves to the first folding configuration 78. However, in this exemplary embodiment the restraining member 58 is approximately 60" long×0.250" in diameter and is folded in half so the two ends of the restraining member 58 are touching. These two ends put together is the proximal end 60. On the other end, the restraining member 58, the bungee cord, will be folded over causing a loop to be made in the distal end 62. See FIG. 5

STEP 2. Couple the releasable fastener 56 to the looped distal end 62 of the restraining member 58. See FIG. 5.

STEP 3. Slide the proximal end 60 of the restraining member 58, starting from the front side of the resilient frame 3, down through the slip member 52.

STEP 4. Slide a cover 72 on the restraining member 58 and create a stopper 74 by tying a knot in the restraining member 58 about 3" down from the distal end 62 of the restraining member 58. Then slide the cover 72 over the stopper 74.

STEP 5. Slide the proximal end 60 of the restraining member 58, starting from the back side of the resilient frame 3, up through the mount 50, or in another exemplary embodiment, up through the anchor 51. The first end 66 of the tether 64 may also slide up through the mount 50, or up through the anchor 51 while assembling as well.

STEP 6. Slide the cover 72 over the restraining member 58 or over the restraining member 58 and the tether 64 if joined.

STEP 7. Create a stopper 74 by tying a knot in the proximal end 60 of the restraining member 58, or if the tether 64 is joined with the restraining member 58, tie a knot in both the proximal end 60 of the restraining member 58 and the first end 66 of the tether 64. Then slide the cover 72 over the stopper 74. Once assembled, the proximal end 60 of the restraining member 58 is coupled to the mount 50 and/or coupled to the anchor 51 while the distal end 62 is slidably coupled to the slip member 52.

In other exemplary embodiments, the restraining member 58 can be made of rope, non-folded over bungee, or of any material type, size, length, configuration, or the like that will function to constrain at least a portion of the resilient frame 3 while moving and resting at the first folding configuration 78. A stopper 74 may also be created in many different ways. For example, tape, a ball, crimped on metal collars, and the like may be used as a stopper 74 as long as the stopper 74 stops the restraining member 58 and/or the tether 64 from pulling through the mount 50, the anchor 51, and/or the slip member 52. Of course, a person of ordinary skill in the art would know a number of ways to create a restraining member 58 and a stopper 74.

Proximal End 60 of the restraining member 58 is illustrated in FIG. 5.

Distal End 62 of the restraining member 58 is illustrated in FIG. 5.

Tether 64 is illustrated in FIGS. 1, 5, & 9-19. The tether 64 may act as a pull cord causing the resilient frame 3 to release from the releasable grasp 38 when force is applied to the tether 64. By releasing the resilient frame 3 from the releasable grasp 38, the resilient frame 3 moves from the second folding configuration 80 to the folded configuration 82.

In one embodiment, the first end 66 of the tether 64 may couple with the mount 50 and/or the anchor 51. In another embodiment, the first end 66 of the tether 64 may couple with the mount 50 and/or the anchor 51 while the second end 68 of the tether 64 slidably couples with the glide member 54. The glide member 54 allows the tether 64 to slide while force is being applied to the second end 68 of the tether 64. In another embodiment, a handle 70 is attached to the second end 68 of the tether 64. The handle 70 can be a folded over loop that is sewn to create a handle 70 in the shape of a loop. In another embodiment, a molded handle 70 made out of plastic, rubber, or the like can also be coupled to the tether 64 by gluing, sewing, or any other acceptable means for attaching the handle 70 to a tether 64.

The tether 64 can be fabricated out of nylon strap, rope, cable, or any other satisfactory material for allowing force to be applied to the tether 64. The length of the tether 64 may vary. For example, the tether 64 can be 1" long, 3' long, 8' long, or any length satisfactory for moving the resilient frame 3 from the second folding configuration 80 to the folded configuration 82.

In another exemplary embodiment, the tether 64 could be fabricated from a rigid tube, fiberglass rod or the like. In this case, the tether 64 could apply a pulling force or a pushing force (if the force is applied from the other direction) to a portion of the resilient frame 3. This pulling force or pushing force is dependent on the side of the resilient frame 3 the force is being applied from. For example, the rigid tether 64 could exert a pulling force if on the right side of the resilient frame 3 or a pushing force if the rigid tether 64 is pushing on the resilient frame 3 from the left side of the resilient frame 3. It should be understood that when describing a "pushing force" that a "pulling force" may also be being described simply by changing the side the force is being applied from.

First End 66 of the tether 64 is illustrated in FIG. 5.

Second End 68 of the tether 64 is also illustrated in FIG. 5.

Handle 70 is illustrated in FIGS. 1, 5, & 9-19.

Cover 72 is illustrated in FIG. 5 In one exemplary embodiment, the cover 72 slides over the stopper 74 for supporting the stopper 74 from pulling through the mount 50, the anchor 51 and/or the slip member 52. The cover 72 slides over the stopper 74 to make the stopper 74 appear to be more aesthetically pleasing to the eye. The cover 72 can be made out of plastic and have a hollow inside cavity for allowing at least a portion of the stopper 74, for example a knot, to rest inside the cover 72 and be enclosed by the stopper 74. The stopper 74 can be molded out of plastic, rubber, or any suitable material for making a stopper 74. Other exemplary embodiments of a cover 72, may be a ball with a through hole and a counter sunk hole running through it. Another example would be two halves of a hollow plastic ball, square, or other shape that can snap around the stopper 74. Stopper 74 is illustrated in FIGS. 1, 5, & 9-13. In one exemplary embodiment, the stopper 74 is a knot tied in the restraining member 58 and/or the first end 66 of the tether 64. Other examples of a stopper 74 could include tape, a ball, a crimped on metal collar, and the like that may be used to successfully support the restraining member 58 and/or the tether 64 from pulling through the mount 50, anchor 51, and/or slip member 52.

2. Exemplary Embodiments—How To Use

In one exemplary embodiment, the following steps may be followed to outline how to use the coiling-assist assembly 36 to fold the foldable structure 1.

Figure 13:
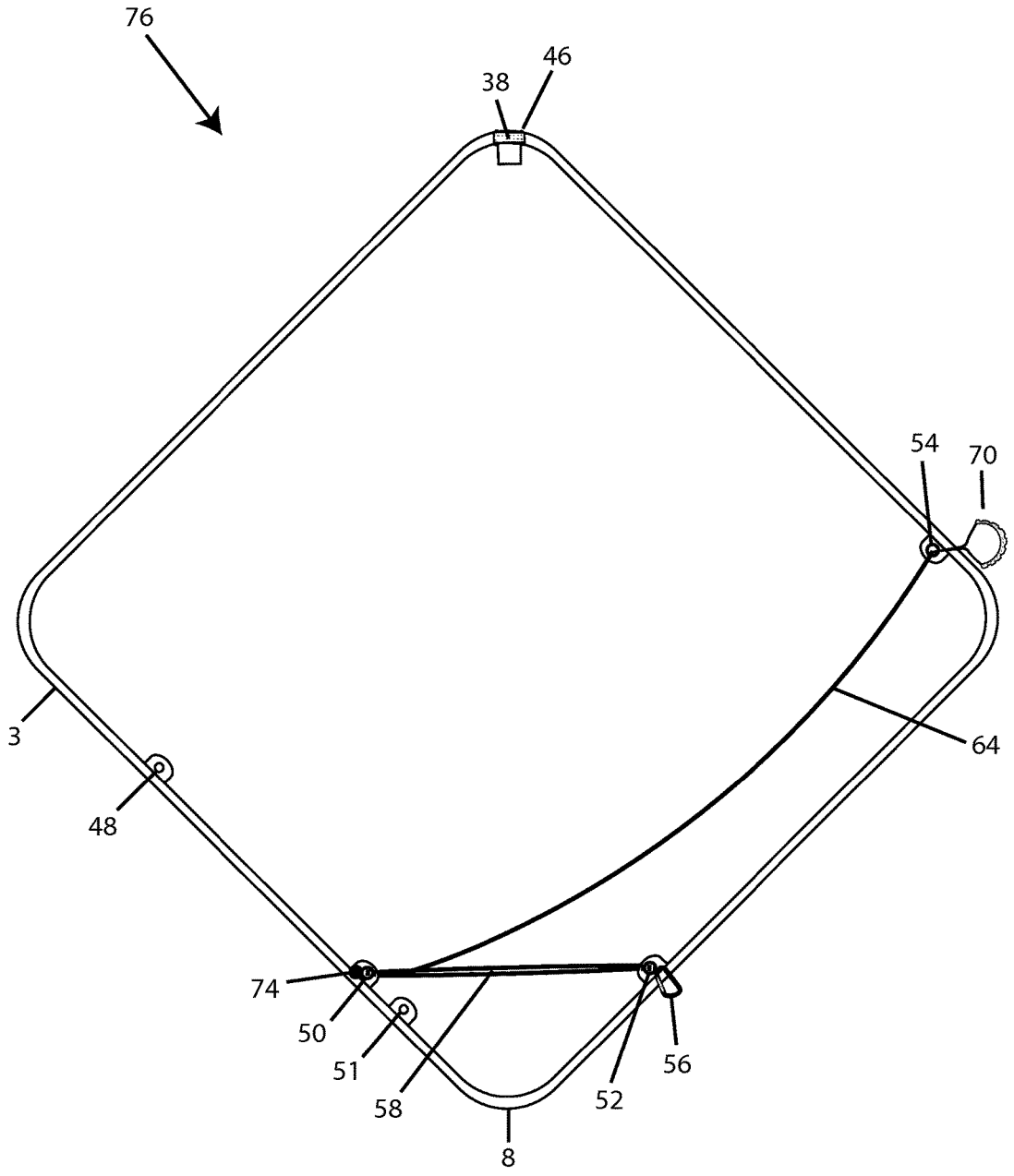
FIG. 13 is a front view illustrating an unfolded configuration.
Figure 14:
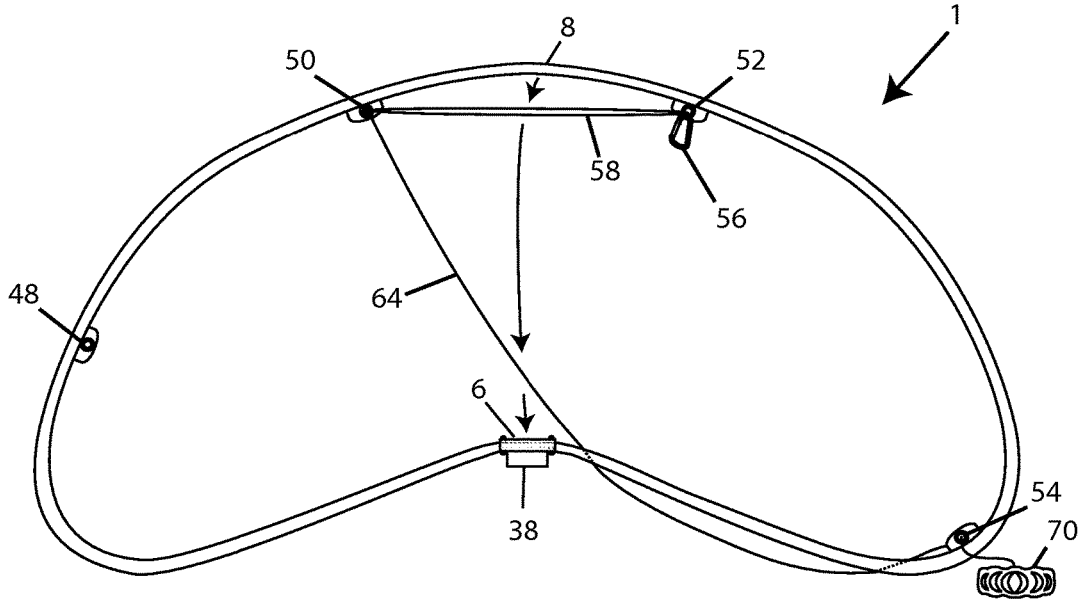
FIG. 14 is a front perspective view illustrating a foldable structure moving between an unfolded configuration to a first folding configuration.

STEP 1. Unfolded Configuration 76 of the foldable structure 1 is illustrated in FIG. 13. Begin by orienting the releasable grasp 38 at the top, as shown in FIG. 13, and orienting the pre-determined second location 8, at the bottom as shown in illustration FIG. 13.

STEP 2. Stand below the pre-determined second location 8 having your left foot off to the left side of the pre-determined second location 8 and your right foot off to the right side of the pre-determined second location 8.

STEP 3. Bend down and grab the resilient frame 3 at the pre-determined second location 8 with your left hand on the left side of the resilient frame 3 and your right hand on the right side of the resilient frame 3.

STEP 4. Referring to FIG. 13 then FIG. 14 and then FIG. 15. Move the foldable structure 1 from the unfolded configuration 76 to the first folding configuration 78 by lifting up at the pre-determined second location 8 of the resilient frame 3, and then tucking the pre-determined second location 8 of the resilient frame 3 down and into the c-shaped section 40 of the releasable grasp 38 located at the pre-determined first location 6. You will insert a section of the resilient frame 3 through the void 41 of the releasable grasp 38 causing the c-shaped section 40 to expand out allowing a section of the resilient frame 3 to be captured in the c-shaped section 40. At this point, the resilient frame 3 is in the first folding configuration 78. See FIG. 15.

Figure 15:
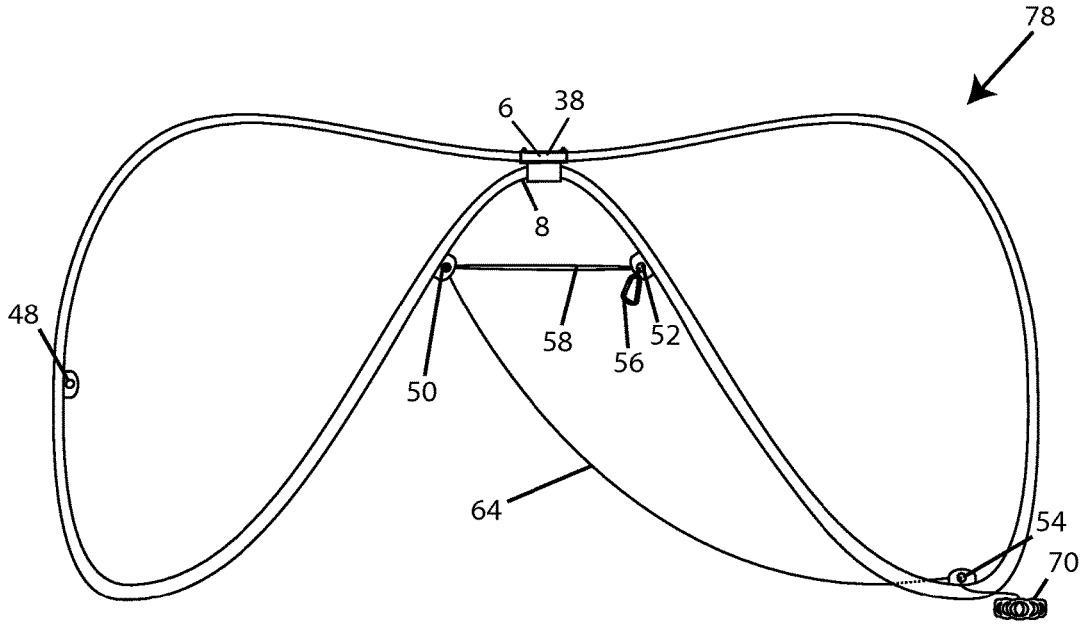
FIG. 15 is a top view illustrating a foldable structure in a first folding configuration.

Please note, when the foldable structure 1 moves from the unfolded configuration 76 to the first folding configuration 78 the restraining member 58 may help constrain the two sides (the one side with the latch 48 and the other side with the glide member 54, see FIG. 15) of the resilient frame 3 so the two sides don't spread out too widely. Constraining the two sides of the resilient frame 3 makes it easier to grab the latch 48 and pull the latch 48 toward the releasable fastener 56 for coupling together while moving from the first folding configuration 78 to the second folding configuration 80. See FIG. 16.

Figure 16:
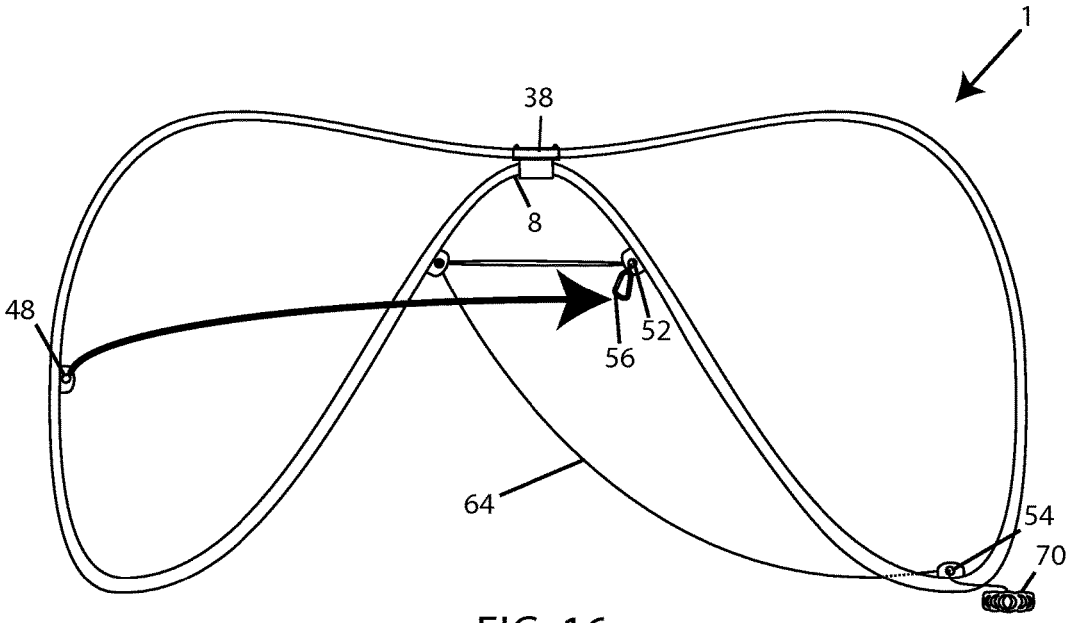
FIG. 16 is a top view illustrating a foldable structure moving between a first folding configuration to a second folding configuration.

STEP 5. Referring to FIG. 16 and then FIG. 17. Move the foldable structure 1 from the first folding configuration 78 to the second folding configuration 80 by pulling the latch 48 toward the releasable fastener 56 and attaching the releasable fastener 56 to the latch 48. The foldable structure 1 is now in the second folding configuration 80. Please note, depending on the force required to attach the releasable fastener 56 to the latch 48 it is possible for the resilient frame 3 to be released from the releasable grasp 38 at this stage.

Figure 18:
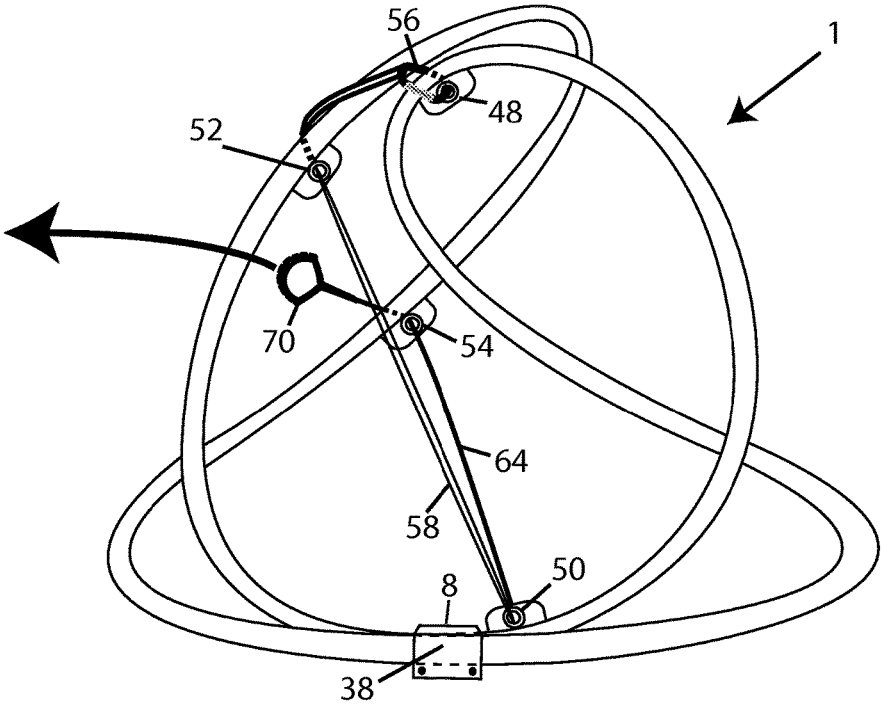
FIG. 18 is a front perspective view illustrating a foldable structure moving between a second folding configuration to a folded configuration.

STEP 6. Referring to FIG. 18 and then FIG. 19. Move the foldable structure 1 from the second folding configuration 80 to the folded configuration 82 by grabbing the handle 70 on the tether 64 and applying a pulling force on the tether 64. This pulling force causes a section of the resilient frame 3 to begin moving out of the c-shaped section 40 of the releasable grasp 38 forward toward the void 41. The resilient frame 3 then moves through the void 41 causing the c-shaped section 40 to expand. The resilient frame 3 then moves out of the void 41 and out of the releasable grasp 38 and moves forward causing the c-shaped section 40 of the releasable grasp 38 to return back to its original unexpanded position and causing the foldable structure 1 to move into the folded configuration 82. Please note, you may also bypass using the tether 64 and apply force directly.

STEP 7. Move the resilient frame 3 from the folded configuration 82 to the unfolded configuration 76 by picking the foldable structure 1 up off the surface, taking the releasable fastener 56 and releasing the releasable fastener 56 from being attached to the latch 48, then slowly releasing the foldable structure 1 thereby allowing the resilient frame 3 to uncoil and move from the folded configuration 82 to the unfolded configuration 76.

In yet another exemplary embodiment, the following steps may be used to outline how to use the coiling-assist assembly 36 to fold the foldable structure 1.

STEP 1. Unfolded Configuration 76 of the foldable structure 1 is illustrated in FIG. 13. Begin by orienting the releasable grasp 38 at the top, as shown in FIG. 13, and orienting the pre-determined second location 8, at the bottom as shown in illustration FIG. 13.

STEP 2. Stand below the pre-determined second location 8 having your left foot off to the left side of the pre-determined second location 8 and your right foot off to the right side of the pre-determined second location 8.

STEP 3. Bend down and grab the resilient frame 3 at the pre-determined second location 8 with your left hand on the left side of the resilient frame 3 and your right hand on the right side of the resilient frame 3.

STEP 4. Referring to FIG. 13 then FIG. 14 and then FIG. 15. Move the foldable structure 1 from the unfolded configuration 76 to the first folding configuration 78 by lifting up at the pre-determined second location 8 of the resilient frame 3, and then tucking and holding the pre-determined second location 8 of the resilient frame 3 down to the pre-determined first location 6 (the releasable grasp 38 is not used in this exemplary embodiment).

Please note, when the foldable structure 1 moves from the unfolded configuration 76 to the first folding configuration 78 the restraining member 58 helps constrain a portion of the two sides (the one side with the latch 48 and the other side with the glide member 54, see FIG. 15) of the resilient frame 3 so the two sides don't spread out too widely. Constraining the two sides of the resilient frame 3 makes it easier to grab the latch 48 and pull the latch 48 toward the releasable fastener 56 for attaching together while moving from the first folding configuration 78 to the second folding configuration 80. See FIG. 16.

STEP 5. Referring to FIG. 16 and then FIG. 17. Move the foldable structure 1 from the first folding configuration 78 to the second folding configuration 80 by pulling the latch 48 toward the releasable fastener 56 and attaching the releasable fastener 56 to the latch 48. The foldable structure 1 is now in the second folding configuration 80.

STEP 6. Referring to FIG. 18 and then FIG. 19. Move the foldable structure 1 from the second folding configuration 80 to the folded configuration 82 by grabbing the handle 70 on the tether 64 and applying pulling force to the tether 64. This pulling force causes a section of the resilient frame 3 to begin moving forward thereby causing the foldable structure 1 to move into the folded configuration 82. Please note, you may also bypass using the tether 64 and apply the pulling force directly by yourself.

STEP 7. Move the resilient frame 3 from the folded configuration 82 to the unfolded configuration 76 by picking the foldable structure 1 up off the surface, taking the releasable fastener 56 and releasing the releasable fastener 56 from being attached to the latch 48, then slowly releasing the foldable structure 1 thereby allowing the resilient frame 3 to uncoil and move from the folded configuration 82 to the unfolded configuration 76.

In yet another exemplary embodiment, you may also follow the above steps and bypass the releasable grasp 38, the latch 48, the releasable fastener 56, and the tether 64 and only use the restraining member 58 to assist in folding the resilient frame 3.

Of course a person of ordinary skill in the art would know a number of ways to make other exemplary embodiments of a coiling-assist assembly 36 for assisting in coiling the resilient frame 3 while folding.

Unfolded configuration 76 of the foldable structure 1 is illustrated in FIG. 13.

First Folding Configuration 78 of the foldable structure 1 is illustrated in FIG. 15.

Figure 17:
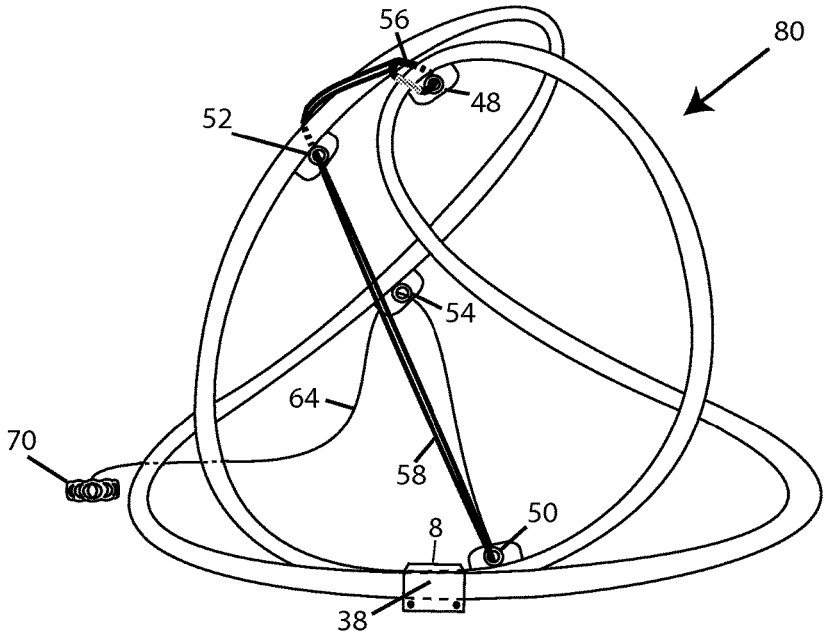
FIG. 17 is a front perspective view illustrating a foldable structure in a second folding configuration.

Second Folding Configuration 80 of the foldable structure 1 is illustrated in FIG. 17.

Figure 19:
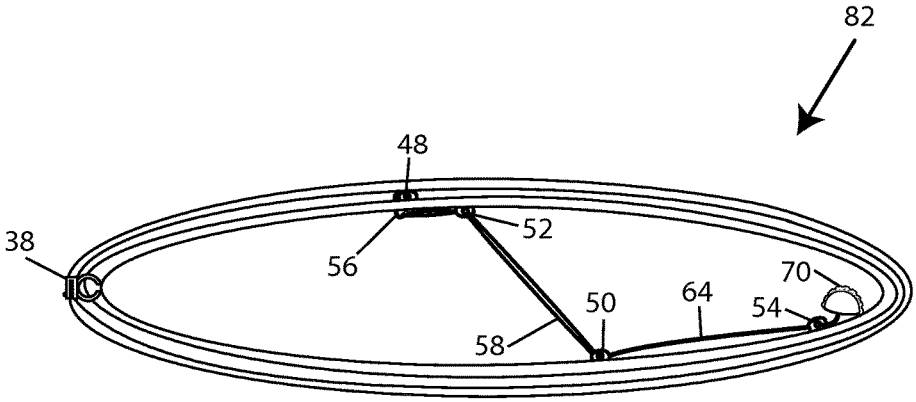
FIG. 19 is a front perspective view illustrating a foldable structure in a folded configuration.

Folded Configuration 82 of the foldable structure 1 is illustrated in FIG. 19

Scope Of The Invention

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an exemplary embodiment", "the exemplary embodiment", "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, Figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. §112 Para. 6. It will be apparent to those having skill in the art that changes may be made to the details of the above-described embodiments without departing from the underlying principles of the invention. Embodiments of the invention in which an exclusive property or privilege is claimed are defined as follows.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

Thus, the scope of the invention should be determined by the appended claims and their legal equivalents, rather than by the foregoing description. All changes which come within the meaning and range of equivalency of the claims are to be embraced within their scope.

I claim:

1. A foldable structure comprising:

I) a resilient frame defining a closed circumference and having a plurality of pre-determined locations disposed on the resilient frame, each pre-determined location of the plurality of pre-determined locations being different from each other pre-determined location, the plurality of pre-determined locations comprising:

a) a pre-determined first location on the resilient frame;

b) a pre-determined second location on the resilient frame;

c) a pre-determined third location on the resilient frame;

d) a pre-determined fourth location on the resilient frame;

e) a pre-determined fifth location on the resilient frame;

f) a pre-determined sixth location on the resilient frame;

g) a pre-determined seventh location on the resilient frame;

II) a coiling-assist assembly moving the resilient frame from an unfolded configuration for use to a folded configuration for storage, the coiling-assist assembly comprising:

a) a releasable grasp coupled to the resilient frame at the pre-determined first location of the resilient frame; and b) the pre-determined second location on the resilient frame is generally diametrically opposed to the pre-determined first location on the resilient frame when the resilient frame is in the unfolded configuration, the pre-determined first location and the pre-determined second location defining a generally diametric line passing either through or proximate to a center point of the closed circumference, the releasable grasp temporarily grasps the resilient frame at the pre-determined second location and holds the resilient frame in a first folding configuration differing from the unfolded configuration, the releasable grasp temporarily grasps the resilient frame until a force is applied either directly or indirectly to the releasable grasp that is sufficient to cause the releasable grasp to release hold of the pre-determined second location.

2. The foldable structure as in claim 1, wherein the generally diametric line between the pre-determined first location and the pre-determined second location when the resilient frame is in the unfolded configuration generally divides the resilient frame into a first semi-circumference of the resilient frame and a second semi-circumference of the resilient frame and the coiling-assist assembly further comprises:

a) a latch coupled to the resilient frame at the pre-determined third location, the pre-determine third location being disposed on the first semi-circumference of the resilient frame; and b) a releasable fastener coupled to the resilient frame at the pre-determined fourth location, the pre-determined fourth location being disposed on the second semi-circumference of the resilient frame, the releasable fastener removably couples with the latch for temporarily holding the resilient frame in a second folding configuration differing from the first folding configuration.

3. The foldable structure as in claim 2, wherein the coiling-assist assembly further comprises a slip member coupled to the resilient frame at the pre-determined fourth location and the releasable fastener is coupled to the slip member.

4. The foldable structure as in claim 1, wherein the resilient frame is substantially round in shape.

5. The foldable structure as in claim 1, further comprising a) a skirt coupled to at least a portion of the resilient frame.

6. The foldable structure as in claim 1, further comprising a) a barrier coupled to the resilient frame.

7. The foldable structure as in claim 1, further comprising a) a base coupled to the resilient frame.

8. The foldable structure as in claim 2, wherein the coiling-assist assembly further comprises:

a) a mount coupled to the resilient frame at the pre-determined fifth location, the pre-determined fifth location being disposed along the resilient frame on the first semi-circumference of the resilient frame between the pre-determined second location and the pre-determined third location when the resilient frame is in the unfolded configuration; and b) a tether having a first end and a second end portion, the first end of the tether is coupled to the mount, the tether moves the resilient frame from the second folding configuration to the folded configuration when force is applied to the tether.

9. The foldable structure as in claim 1, further comprising a) a handle coupled to the second end of the tether.

10. The foldable structure as in claim 8, wherein the coiling-assist assembly further comprises:

a) a glide member coupled to the resilient frame at the pre-determined seventh location, the pre-determined seventh location being disposed on the second semi-circumference of the resilient frame, the second end portion of the tether slidably engages the glide member for allowing the tether to slide when force is applied to the tether.

11. The foldable structure as in claim 10, wherein the coiling-assist assembly further comprises:

a) a restraining member having a proximal end and a distal end portion, the proximal end of the restraining member is coupled to the mount and the distal end portion of the restraining member is coupled to a slip member, the restraining member constrains at least a portion of the resilient frame while the resilient frame moves to the first folding configuration.

12. The foldable structure as in claim 10, wherein the coiling-assist assembly further comprises:

a) a restraining member having a proximal end and a distal end portion, the proximal end of the restraining member is coupled to an anchor and the distal end portion of the restraining member is coupled to a slip member, the restraining member constrains at least a portion of the resilient frame while the resilient frame moves to the first folding configuration.

13. The foldable structure as in claim 2, wherein the coiling-assist assembly further comprises:

a) an anchor coupled to the resilient frame at the pre-determined sixth location, the pre-determined sixth location being disposed along the resilient frame on the first semi-circumference of the resilient frame between the pre-determined second location and the pre-determined third location when the resilient frame is in the unfolded configuration; and b) a tether having a first end and a second end portion, the first end of the tether is coupled to the anchor, the tether moves the resilient frame from the second folding configuration to the folded configuration when force is applied to the tether.

14. The foldable structure as in claim 13, wherein the coiling-assist assembly further comprises:

a) a glide member coupled to the resilient frame at the pre-determined seventh location, the pre-determined seventh location being disposed on the second semi-circumference of the resilient frame, the second end portion of the tether slidably engages the glide member for allowing the tether to slide when force is applied to the tether.

15. The foldable structure as in claim 14, wherein the coiling-assist assembly further comprises:

a) a restraining member having a proximal end and a distal end portion, the proximal end of the restraining member is coupled to the anchor and the distal end portion of the restraining member is coupled to a slip member, the restraining member constrains at least a portion of the resilient frame while the resilient frame moves to the first folding configuration.

16. The foldable structure as in claim 14, wherein the coiling-assist assembly further comprises:

a) a restraining member having a proximal end and a distal end portion, the proximal end of the restraining member is coupled to a mount and the distal end portion of the restraining member is coupled to a slip member, the restraining member constrains at least a portion of the resilient frame while the resilient frame moves to the first folding configuration.

17. A foldable structure comprising:

I) a resilient frame defining a closed circumference and having a plurality of pre-determined locations disposed on the resilient frame, each pre-determined location of the plurality of pre-determined locations being different from each other pre-determined location, the plurality of pre-determined locations comprising:

a) a pre-determined first location on the resilient frame;

b) a pre-determined second location on the resilient frame;

c) a pre-determined third location on the resilient frame;

d) a pre-determined fourth location on the resilient frame;

e) a pre-determined fifth location on the resilient frame;

f) a pre-determined sixth location on the resilient frame; and g) a pre-determined seventh location on the resilient frame;

II) the pre-determined second location being disposed on the resilient frame generally diametrically opposed to the pre-determined first location when the resilient frame is in an unfolded configuration, a line passing through the pre-determined first location and the pre-determine second location generally divides the resilient frame into a first semi-circumference of the resilient frame and a second semi-circumference of the resilient frame; and III) a coiling-assist assembly moving the resilient frame from the unfolded configuration for use, to a first folding configuration, to a second folding configuration differing from the first folding configuration, to a folded configuration for storage, the coiling-assist assembly comprising:

a) a latch coupled to the resilient frame at the pre-determined third location, the pre-determined third location being disposed on the first semi-circumference of the resilient frame; and b) a releasable fastener coupled to the resilient frame at the pre-determined fourth location, the pre-determined fourth location being disposed on the second semi-circumference of the resilient frame, the releasable fastener removably connects with the latch for temporarily holding the resilient frame in the second folding configuration.

18. The foldable structure as in claim 17, wherein the coiling-assist assembly further comprises:

a) a slip member coupled to the resilient frame at the pre-determined fourth location, the slip member couples the releasable fastener to the resilient frame.

19. The foldable structure as in claim 17, wherein the coiling-assist assembly further comprises:

a) a mount coupled to the resilient frame at the pre-determined fifth location, the pre-determined fifth location being disposed along the resilient frame on the first semi-circumference of the resilient frame between the pre-determined second location and the pre-determined third location when the resilient frame is in the unfolded configuration; and b) a tether having a first end and a second end portion, the first end of the tether is coupled to the mount, the tether moves the resilient frame from the second folding configuration to the folded configuration when force is applied to the tether.

20. The foldable structure as in claim 19, wherein the coiling-assist assembly further comprises:

a) a glide member coupled to the resilient frame at the pre-determined seventh location, the pre-determined seventh location being disposed on the second semi-circumference of the resilient frame, the second end portion of the tether slidably engages the glide member for allowing the tether to slide when force is applied to the tether.

21. The foldable structure as in claim 20, wherein the coiling-assist assembly further comprises:

a) a restraining member having a proximal end and a distal end portion, the proximal end of the restraining member is coupled to the mount and the distal end portion of the restraining member is coupled to a slip member, the restraining member constrains at least a portion of the resilient frame while the resilient frame moves to the first folding configuration.

22. A foldable structure as in claim 21, wherein the coiling-assist assembly further comprises:

a) a restraining member having a proximal end and a distal end portion, the proximal end of the restraining member is coupled to an anchor and the distal end portion of the restraining member is coupled to a slip member, the restraining member constrains at least a portion of the resilient frame while the resilient frame moves to the first folding configuration.

23. The foldable structure as in claim 17, wherein the coiling-assist assembly further comprises:

a) an anchor coupled to the resilient frame at the pre-determined sixth location the pre-determined sixth location being disposed along the resilient frame on the first semi-circumference of the resilient frame between the pre-determined second location and the pre-determined third location when the resilient frame is in the unfolded configuration; and b) a tether having a first end and a second end portion, the first end of the tether is coupled to the anchor, the tether moves the resilient frame from the second folding configuration to a folded configuration when force is applied to the tether.

24. The foldable structure as in claim 23, wherein the coiling-assist assembly further comprises:

a) a glide member coupled to the resilient frame at the pre-determined seventh location, the pre-determined seventh location being disposed on the second semi-circumference of the resilient frame, the second end portion of the tether slidably engages the glide member for allowing the tether to slide when force is applied to the tether.

25. The foldable structure as in claim 24, wherein the coiling-assist assembly further comprises:

a) a restraining member having a proximal end and a distal end portion, the proximal end of the restraining member is coupled to the anchor and the distal end portion of the restraining member is coupled to a slip member, the restraining member constrains at least a portion of the resilient frame while the resilient frame moves to the first folding configuration.

26. The foldable structure as in claim 24, wherein the coiling-assist assembly further comprises:

a) a restraining member having a proximal end and a distal end portion, the proximal end of the restraining member is coupled to a mount and the distal end portion of the restraining member is coupled to a slip member, the restraining member constrains at least a portion of the resilient frame while the resilient frame moves to the first folding configuration.

27. A foldable structure comprising:

I) a resilient frame defining a closed circumference and having a plurality of pre-determined locations disposed on the resilient frame, each pre-determined location of the plurality of pre-determined locations being different from each other pre-determined location, the plurality of pre-determined locations comprising:

a) a pre-determined first location on the resilient frame;

b) a pre-determined second location on the resilient frame;

c) a pre-determined third location on the resilient frame;

d) a pre-determined fourth location on the resilient frame;

e) a pre-determined fifth location on the resilient frame; and f) a pre-determined sixth location on the resilient frame;

II) the pre-determined second location being disposed on the resilient frame generally diametrically opposed to the pre-determined first location, a line passing through the pre-determined first location and the pre-determined second location generally divides the resilient frame into a first semi-circumference of the resilient frame and a second semi-circumference of the resilient frame; and III) a coiling-assist assembly moving the resilient frame from an unfolded configuration for use, to a first folding configuration, to a second folding configuration differing from the first folding configuration, to a folded configuration for storage, the coiling-assist assembly comprising:

a) a restraining member having a proximal end and a distal end portion, the proximal end and the distal end portion of the restraining member are coupled to the resilient frame, the restraining member constrains at least a portion of the resilient frame while the resilient frame moves to a first folding configuration;

b) a releasable fastener coupled to the distal end portion of the restraining member, the releasable fastener removably connects with a latch; and c) a slip member coupled to the resilient frame at the pre-determined fourth location, the pre-determined fourth location being disposed on the second semi-circumference of the resilient frame, the distal end portion of the restraining member slidably engages the slip member.

28. The foldable structure as in claim 27, wherein the coiling-assist assembly further comprises:

a mount coupled to the resilient frame at the pre-determined fifth location, the pre-determined fifth location being disposed on the first semi-circumference of the resilient frame, whereby the mount is coupled to the proximal end of the restraining member and the slip member is coupled to the distal end portion of the restraining member.

29. The foldable structure as in claim 27, wherein the coiling-assist assembly further comprises:

an anchor coupled to the resilient frame at the pre-determined sixth location, the pre-determined sixth location being disposed on the first semi-circumference of the resilient frame, whereby the anchor is coupled to the proximal end of the restraining member and the slip member is coupled to the distal end portion of the restraining member.

30. The foldable structure as in claim 27, wherein the restraining member is stretchable.

* * * * *